US008406639B2

(12) United States Patent
Yamanaka et al.

(10) Patent No.: US 8,406,639 B2
(45) **Date of Patent: *Mar. 26, 2013**

(54) PRINTING SYSTEM, SHEET SUPPLY SUPPORTING METHOD AND CONTROL PROGRAM

(75) Inventors: Toshihisa Yamanaka, Hachioji (JP); Kazuhisa Kishimoto, Mitaka (JP); Yukihiko Ichikawa, Hachioji (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 741 days.

This patent is subject to a terminal disclaimer.

(21) Appl. No.: 12/408,004

(22) Filed: Mar. 20, 2009

(65) Prior Publication Data

US 2009/0315249 A1 Dec. 24, 2009

(30) Foreign Application Priority Data

Jun. 23, 2008 (JP) ..... 2008-162812

(51) Int. Cl.
*G03G 15/00* (2006.01)

(52) U.S. Cl. ..... 399/23; 399/393

(58) Field of Classification Search ..... 399/23, 399/393

See application file for complete search history.

(56) References Cited

U.S. PATENT DOCUMENTS

2008/0075479 A1* 3/2008 Genda ..... 399/23

FOREIGN PATENT DOCUMENTS

| | | | |
|---|---|---|---|
| JP | 61-023049 | | 1/1986 |
| JP | 05-301430 | | 11/1993 |
| JP | 2005-306573 | | 11/2005 |
| JP | 2006-137595 | | 6/2006 |
| JP | 2007210784 | A * | 8/2007 |
| JP | 2007-276339 | | 10/2007 |
| JP | 2008-127154 | | 6/2008 |

OTHER PUBLICATIONS

Machine translation of JP 2007210784 Kinoshita, Takeshi.*

Japanese Office Action in corresponding Japanese Patent Application No. 2008-162812, dated Apr. 16, 2010, with translation.

* cited by examiner

*Primary Examiner* — Matthew G Marini
*Assistant Examiner* — Allister Primo
(74) *Attorney, Agent, or Firm* — Buchanan Ingersoll & Rooney PC

(57) ABSTRACT

A printing system, comprises a plurality of image forming apparatuses connected to a network and including sheet trays and a detecting section provided to each sheet tray and to detect a capacity of empty space of each sheet tray; and a sheet managing section to obtain a capacity of empty space of each sheet tray of each image forming apparatus and to compare the capacity of empty space of each sheet tray with a capacity of one bundle of sheets as a unit of supply. In the case that the capacity of empty space of a sheet tray among the plural sheet trays of the plurality of image forming apparatuses is equal to or larger than the capacity of one plural bundle of sheets, the sheet managing section notifies that sheet supply can be conducted by one bundle of sheets as a unit of supply to the sheet tray.

9 Claims, 17 Drawing Sheets

PRINTING SYSTEM, SHEET SUPPLY SUPPORTING METHOD AND CONTROL PROGRAM

This application is based on Japanese Patent Application No. 2008-162812 filed on Jun. 23, 2008 in Japanese Patent Office, the entire content of which is hereby incorporated by reference.

BACKGROUND OF THE INVENTION

The present invention relates to a printing system including a plurality of image forming apparatuses, a sheet supply supporting method of supporting to make it possible to supply sheets by one bundle or a box as a unit of supply into sheet trays of image forming apparatuses and a control program to judge whether it is possible to supply sheets by one bundle or a box as a unit of supply. Here, in the present specification, a sheet-shape recording material to form an image thereon, such as a copy paper, a recording sheet and the like is referred to as "sheet".

Printing apparatuses (hereafter, referred to as image forming apparatuses), such as printers and digital composite machines have been widely used. Such an image forming apparatus conducts processes of forming an image based on a print job and transfers the image onto a sheet stored in a sheet tray. However, if there is no sheet in the tray, the print job is interrupted. Therefore, the sheet administration such as, purchase, storage and supply is very important for the operation of the image forming apparatus.

With regard to the sheet administration in an image forming apparatus, a generally known technique detects a quantity of remaining sheets in a sheet tray and notifies the necessity of sheet supply if the quantity of remaining sheets becomes equal to or less than a threshold value. For example, Japanese Patent Unexamined Publication No. 5-301430 discloses a technique to urge an operator to conduct sheet supply by indication or alarm in the case that the quantity of remaining sheets is little at the time of starting a print operation or at the time that a print operation is stopped by occurrence of errors.

Here, sheets used in image forming apparatuses are purchased on a packaged condition that hundreds of sheets are made in one bundle and then one or plural bundles of sheets are stored in a box. When a package is opened and some sheets of one bundle of sheets are supplied to a sheet tray, the remaining sheets are preserved in many cases on the condition that they are carelessly piled up on a shelf. In this case, there is a problem that the remaining sheets become dirty or are partially bent and then become unable to be used. In addition, there is another problem that the remaining sheets spoil a fine view.

In order to avoid the above problems, it is desired to supply sheets by one or plural bundles (for example, one box) as a unit of supply. However, since the size of a sheet tray is generally set so as to store one bundle or plural bundles of sheets exactly, if sheet supply is conducted on the condition that sheets remain in a sheet tray, some sheets of a bundle of sheets cannot be stored in the sheet tray. As a result, it becomes impossible to avoid the above problems.

Therefore, with the conventional technique, since sheet supply can be conducted before all of sheets in a sheet tray have been used, from the viewpoint for an apparatus to conduct a print job, the interruption of the print job due to no sheet can be avoided. However, from the viewpoint for an operator to conduct sheet supply, it becomes necessary for the operator to administrate sheets remaining after the sheet supply. As mentioned above, the remaining sheets become dirty or are partially bent and then become unable to be used. Therefore, there are problems to cause loss in cost and resource and to spoil a fine view of a sheet storage place.

SUMMARY

The present invention has been achieved in view of the above-mentioned problems. An object of the present invention is to provide a printing system capable of supplying sheets by one or plural bundles as a unit of supply, a sheet supply supporting method and a control program for the sheet supply.

In order to achieve the above object, a printing system which reflects an aspect of the present invention, comprises a plurality of image forming apparatuses, each of the plurality of image forming apparatuses connected to a network and including one or plural sheet trays to store sheets to form images thereon and a detecting section provided to each of the one or plural sheet trays and to detect a capacity of empty space of each of the one or plural sheet trays; and a sheet managing section to obtain a capacity of empty space of each of the one or plural sheet trays of each of the plurality of image forming apparatuses and to compare the capacity of empty space of each of the one or plural sheet trays with a capacity of sheets of one or plural bundles of sheets as a unit of supply to be stored in the one or plural sheet trays, wherein in the case that the capacity of empty space of a sheet tray among the one or plural sheet trays of the plurality of image forming apparatuses is equal to or larger than the capacity of sheets of one or plural bundles of sheets, the sheet managing section notifies that sheet supply can be conducted by one or plural bundle of sheets as a unit of supply to the sheet tray.

In the aforementioned image forming apparatus, the sheet managing section preferably specifies plural sheet trays of plural image forming apparatuses storing sheets of the same size and the same kind and compares a total capacity of empty space of the plural sheet trays with a capacity of sheets of one or plural bundles of sheets as a unit of supply to be stored in the plural sheet trays, and in the case that the total capacity of empty space is equal to or larger than the capacity of sheets of one or plural bundles of sheets, the sheet managing section preferably notifies that sheet supply can be conducted by the one or plural bundle of sheets as a unit of supply to the plural sheet trays by distributing the one or plural bundle of sheets to the plural sheet trays.

In the aforementioned image forming apparatus, the printing system preferably further comprises a display section; and the sheet managing section preferably controls the display section to indicate a screen to select image forming apparatuses and sheet trays in the printing system and makes the selected sheet trays of the image forming apparatuses as objects for an adding calculation of the total capacity of empty space.

In the aforementioned image forming apparatus, in the case that there are plural combinations of sheet trays in which the total capacity of empty space of the sheet trays of each of the combinations becomes equal to or larger than the capacity of sheets of one or plural bundles of sheets, the sheet managing section preferably notifies preferentially a combination in which image forming apparatuses having the sheet trays are located relatively close to each other.

DETAILED DESCRIPTION OF PREFERRED EMBODIMENTS

Hereafter, a preferable embodiment according to the present invention will be explained. However, the present invention is not limited to this embodiment.

As described in the section "BACKGROUND OF THE INVENTION", at the time of supplying sheets to a sheet tray of an image forming apparatus, the sheet supply is conducted in accordance with warning such as nearly empty and the like so that a print job is not interrupted. However, at the stage of nearly empty, some sheets remain in the sheet tray. Generally, since the maximum storage capacity of a sheet tray is the same with the capacity of sheets of one bundle or plural bundles, some sheets of one bundle remain without being supplied into the sheet tray. Therefore, there are problems that the remaining sheets are damaged during storage or scattered on a storage place and spoil a fine view of the storage place. Further, usually, sheets are covered by a moisture proof paper for each bundle of sheets during storage. Therefore, the moisture content of the remaining sheets changes due to the change of humidity surrounding them.

Then, in this embodiment, in order to store all sheets of a desired amount of sheets (one bundle of sheets, plural bundles of sheets, or a box of sheets) as a unit of supply into a sheet tray without remaining sheets, a capacity of empty space of each sheet tray is detected with a predetermined timing by a capacity detecting section provided to each sheet tray of each image forming apparatus, the capacity of empty space of each of one or plural sheet trays of one or plural image forming apparatuses is compared with a capacity of sheets of a desired amount of sheets as a unit of supply. As a result of comparison, in the case that the capacity of empty is equal to or larger than the capacity of sheets of a desired amount of sheets, it is notified that sheet supply can be conducted by the desired amount of sheets as a unit of supply.

Accordingly, a user can conduct sheet supply by the desired amount of sheet as a unit of supply in accordance with the notice. Since it is not necessary to preserve sheets on the condition that a package is opened, it is possible to solve the problems of damaging sheets and spoiling a fine view. In addition, it is also possible to eliminate a trouble to secure a storage location for sheets and a labor to shift sheets remaining after sheet supply to the storage location. Further, it is possible to avoid the change of the moisture content of the preserved remaining sheets.

Embodiment 1

Figure 1:
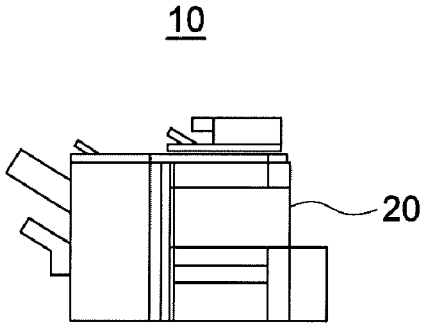
FIG. 1 is a schematic illustration showing a structure of a printing system according to the first embodiment of the present invention.
Figure 2:
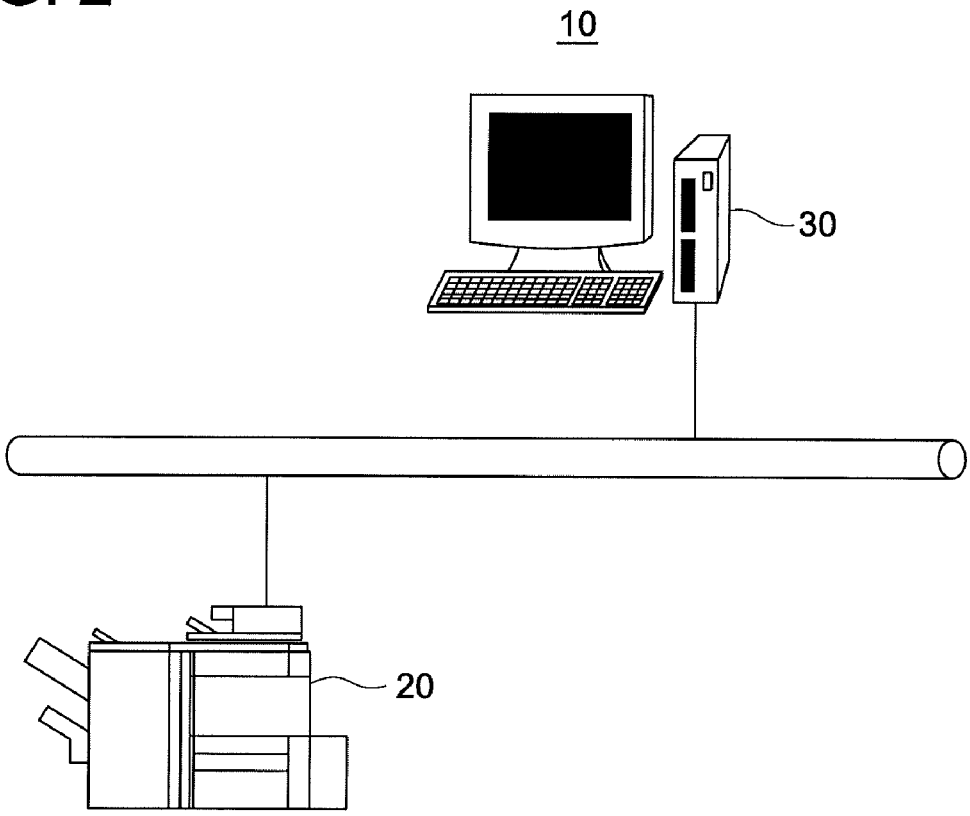
FIG. 2 is a schematic illustration showing another structure of a printing system according to the first embodiment of the present invention.
Figure 3:
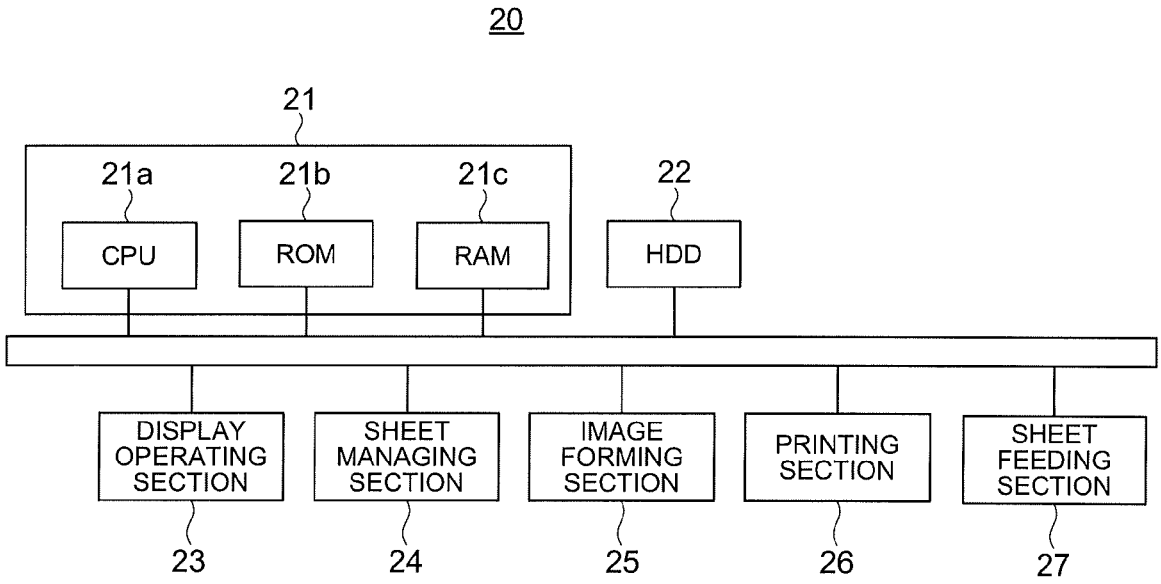
FIG. 3 is a block diagram showing a structure of an image forming apparatus according to the first embodiment of the present invention.
Figure 4:
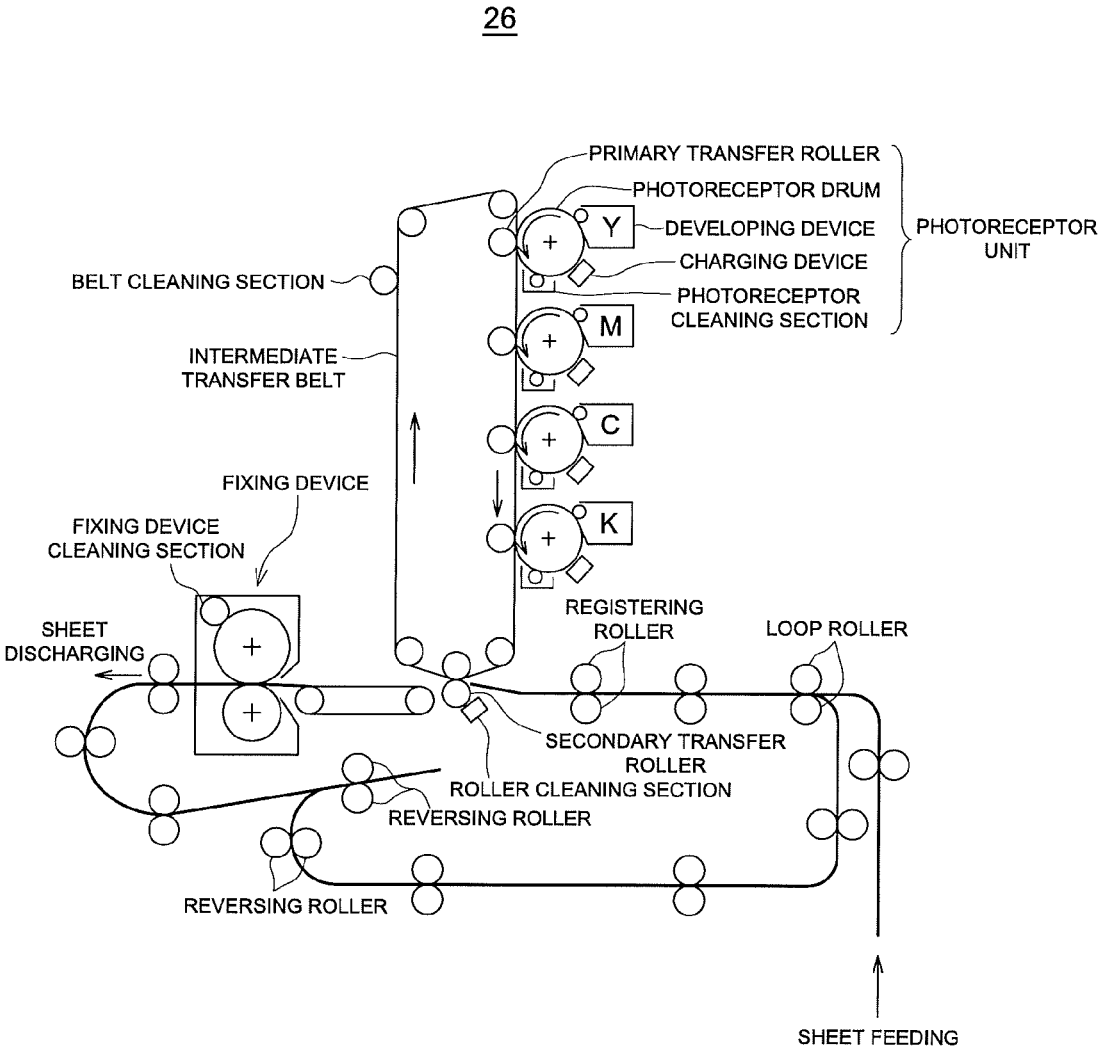
FIG. 4 is a schematic diagram showing a structure example of a printing section of an image forming apparatus according to the first embodiment of the present invention.
Figure 5:
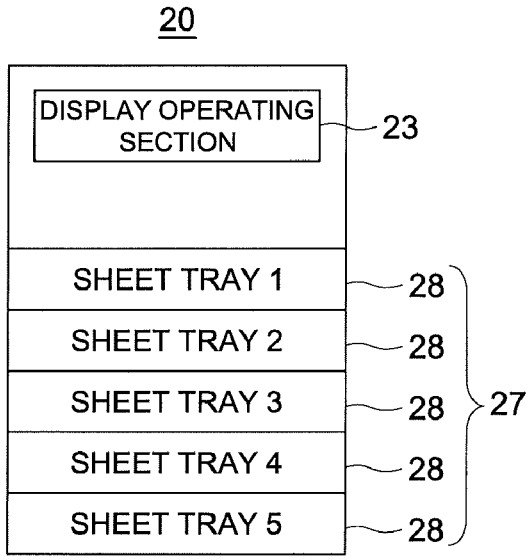
FIG. 5(*a*) and FIG. 5(*b*) each is a schematic diagram showing a structure example of a sheet feeding section of an image forming apparatus and a structural example of a capacity detecting section in a sheet tray according to the first embodiment of the present invention.
Figure 5:
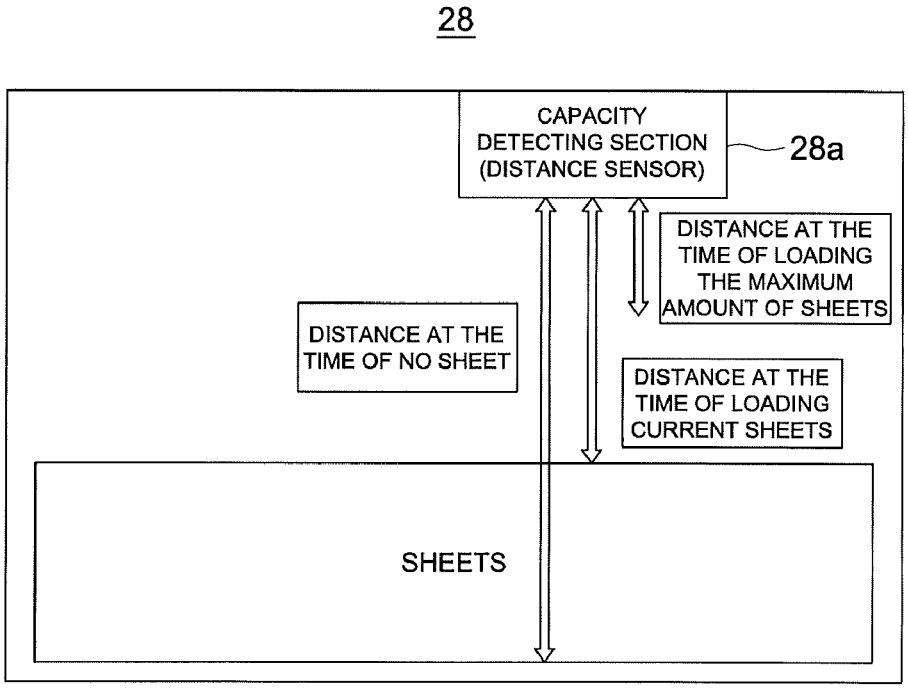

In order to explain more in detail about an embodiment of the above-mentioned present invention, an image forming apparatus, sheet supply supporting method, and control program according to one example of the present invention will be explained with reference to FIGS. 1 through 20. FIG. 1 and FIG. 2 each is a schematic illustration showing a structure of a printing system of the present example, and FIG. 3 is a block diagram showing a structure of an image forming apparatus of the present example. Further, FIG. 4 is a schematic diagram showing a structure example of a printing section of an image forming apparatus, and FIG. 5 is a schematic diagram showing a structure example of a sheet feeding section of an image forming apparatus and a structural example of a capacity detecting section in a sheet tray. FIG. 6 through FIG. 10 each is a flow chart showing an action of an image forming apparatus of the present example, and FIG. 11 through FIG. 20 each is an illustration showing one example of a screen displayed on a display operating section of an image forming apparatus.

As shown in FIG. 1, a printing system 10 of this example is constituted by an image forming apparatus 20, such as a printer and a digital composite machine.

As shown in FIG. 3, this image forming apparatus 20 comprises a control section 21 including CPU (Central Processing Unit) 21*a*, a ROM (Read Only Memory) 21*b*, a RAM (Random Access Memory) 21*c*, and the like, a HDD (Hard Disk Drive) 22, a display operating section 23, a sheet managing section 24, an image forming section 25, a printing section 26, a sheet feeding section 27, and the like The ROM 21*b* memorizes data (for example, the maximum storage capacity of each sheet tray, etc.) required for a program and a control to control the operations of the entire image forming apparatus. The RAM21*c* memorizes data necessary for a control by the CPU 21*a* and data (for example, sheet information or a capacity of empty space of a sheet tray) necessary for being memorized temporarily at the time of control operations and the like. Then, the CPU 21*a* functions as a control section 21 to control the overall operation of the image forming apparatus in cooperation with the ROM 21*b* and the RAM 21*c*.

The HDD 22 saves data (for example, sheet information or a capacity of empty space of a sheet tray) necessary for a print job, the control of the control section 21, and the like.

The display operating section 23 is constituted by a display section, such as LCD (Liquid Crystal Display) and an operating section such as a touch panel covering the display section. The display operating section 23 displays the various screens mentioned later and enables input/selection of sheet information and a notice time, and the like. Here, the display section and the operating section are constituted in one body in this example. However, the display section and the operating section can be constituted separately.

The sheet managing section 24 calculates the capacity of empty space (the amount of sheets capable of being stored) of each sheet tray on the basis of the output of a capacity detecting section which is provided in the sheet tray and mentioned later, and compares this capacity of empty space with a capacity of sheets if a desired amount of sheet (one bundle, plural bundles, or a box) as a unit of supply. As a result of the comparison, if the capacity of empty space becomes equal to or larger than the capacity of sheets of the desired amount of sheet as a unit of supply, the sheet managing section 24 notifies that sheet supply by the desired amount of sheet as a unit of supply becomes possible. This sheet managing section 24 can be constituted as hardware in the image forming apparatus 20. Also, the sheet managing section 24 can be constituted as a control program to make a computer to act as the sheet managing section 24, and this control program can be constituted to work on the control section 21.

The image forming section 25 rasterizes data of each page of a print job, performs an image processing and a screening if needed, and forms bit map data capable of being printed at the printing section 26.

The printing section 26 transfers an image of the bit map data formed by the image forming section 24 onto a sheet by using an image forming process, such as an electrophotographying process and electrostatic recording process. Concretely, as shown in FIG. 4, the printing section 26 is constituted by a writing unit (not shown in any drawing) to exposes by irradiating a laser beam based on the bit map data inputted from the image forming section 25; a photoreceptor which comprises a photoreceptor drum, a developing device, an electrically-charging device, a photoreceptor cleaning section, and a primary transfer roller and forms a toner image of each color of yellow (Y), Magenta (M), cyan (C), and black (K); an intermediate transfer belt which is rotated with rollers and functions as an intermediate transfer member to convey the toner image formed by the photoreceptor unit to a sheet; a belt cleaning section to clean the above intermediate transfer belt; a secondary transfer rollers to transfer the toner image formed on the intermediate transfer belt onto a sheet; a roller cleaning section to conduct transfer of the toner image and cleaning by applying voltage to the above second transfer rollers; a fixing device to fix the toner image transferred on the sheet; a fixing device cleaning section to cleans the fixing device; a conveying section, such as a feed roller, a registering roller, a loop roller, a reversing roller, and a sheet ejecting roller, to convey a desired sheet from a sheet feeding section 27, and the like.

The sheet feeding section 27 is constituted by plural sheet trays 28, as shown in FIG. 5(*a*), and a capacity detecting section (for example, optical type distance sensor) 29 to detects a sheet remaining quantity physically as shown in FIG. 5(*b*) is installed in the upper part of each sheet tray 28.

This distance sensor is equipped with a light emitting section and a light receiving section, these are arranged with the positional relationship that light emitted from the light emitting section reflects on a top surface of sheet in the sheet tray 28 and returns to the light receiving section. At this time, the distance to the top surface of a sheet can be calculated from which one of positions of the photo detector of the light receiving section the reflected light is returned to. Here, this capacity detecting section is not limited to only the above optical distance sensor. For example, a weight detecting sensor which is installed in the lower part of the sheet tray 28 and detects the weight of sheets, and a position detecting sensor which is arranged in terms of a sheet stack direction and detects the loaded amount of sheets, and the like can be used as the capacity detecting section.

Here, in FIG. 1, the printing system 10 of this embodiment is constituted only by the image forming apparatus 20. However, as shown in FIG. 2, the printing system 10 can be constituted such that a computer terminal 30, such as a printer controller and a client, is connected to the image forming apparatus 20 through a communication network, such as LAN (Local Area Network) and WAN (Wide Area Network). In this case, a network connecting section, such as NIC (Network Interface Card) and a modem, is added in the image forming apparatus 20, and the sheet managing section 24 can be provided as hardware or software to either the image forming apparatus 20 or the computer terminal 30.

Figure 6:
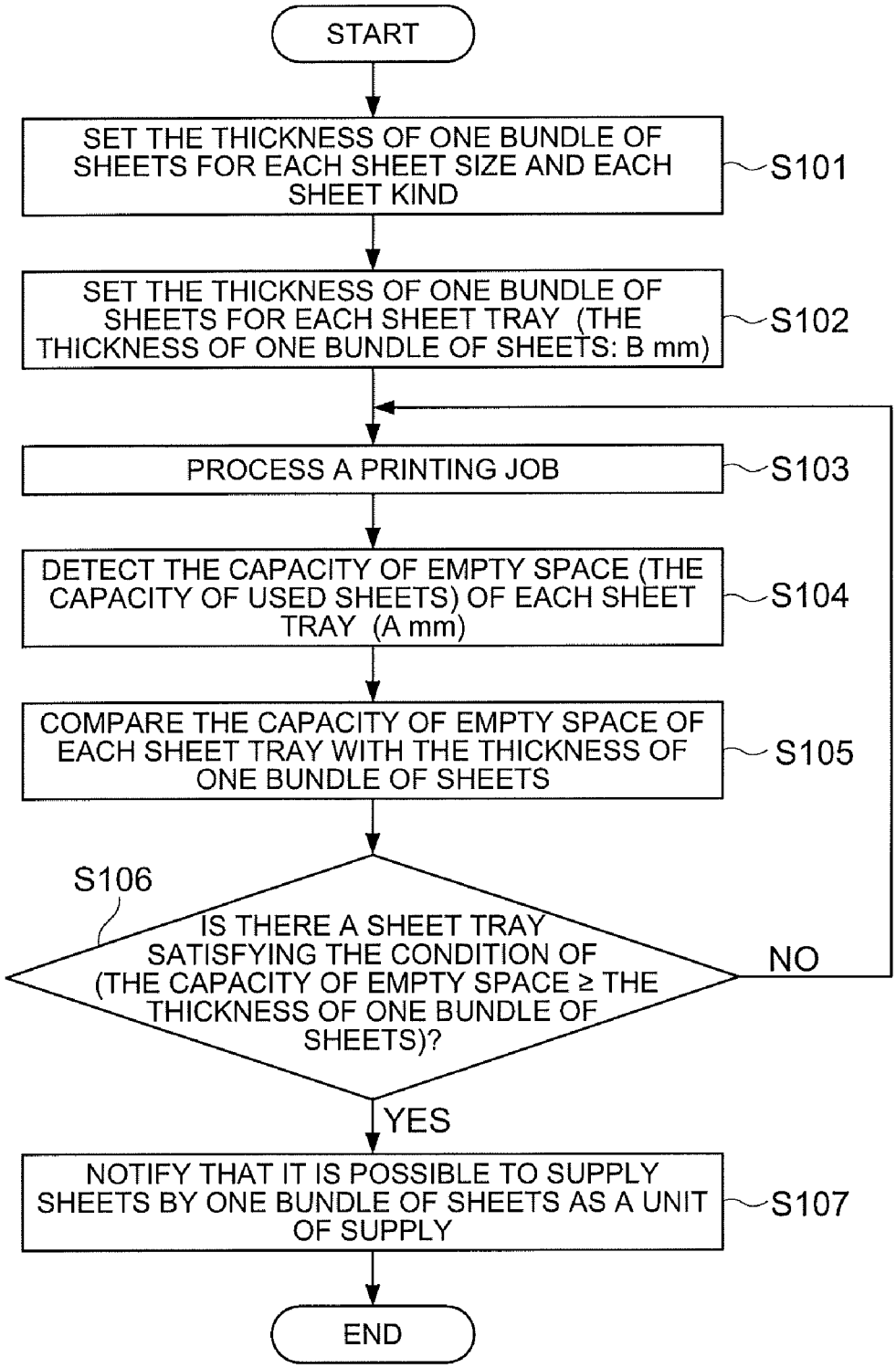
FIG. 6 is a flow chart showing the procedures of a sheet supply supporting method (in the case of judging the propriety (right or wrong) of replenishment by one bundle of sheets as a unit of supply based on the thickness of sheets) according to the first embodiment of the present invention.

Hereafter, a sheet supply supporting method in the image forming apparatus 20 with the above structure is explained with reference to the flow chart of FIG. 6. Here, FIG. 6 shows the procedures in the case of judging the propriety of supply (replenishment) by one bundle of sheets as a unit of supply based on the thickness of sheets.

[Flow in the Case of Judging the Propriety of Supply by One Bundle of Sheets as a Unit of Supply Based on the Thickness of Sheets]

Figure 11:
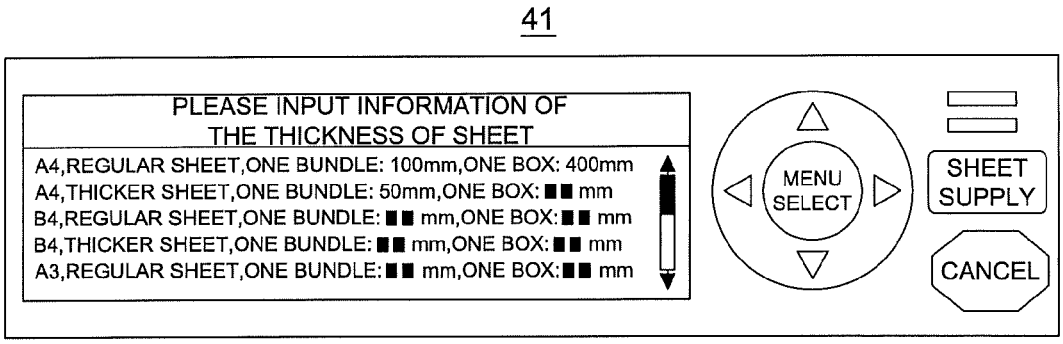
FIG. 11 is an illustration showing a structural example of a screen (sheet information setting screen) displayed on a display operating section of an image forming apparatus according to the first embodiment of the present invention.

First, at Step S101, the control section 21 makes the display operating section 23 to display a sheet information setting screen 41 as shown in FIG. 11. This sheet information setting screen 41, for example, is provided with a column to input the thickness of sheets in one bundle and the thickness of sheets in one box for each of sheet sizes (for example, A4, B4, A3, etc.) and sheet kinds (for example, a regular paper, cardboard, coated paper, recycled paper, etc.). A user sets up sheet information, such as the thickness of sheets in one bundle for each of sheet sizes and sheet kinds by operating the display operating section 23. Then, the control section 21 memorizes the sheet information for each of sheet sizes and sheet kinds in the ROM 21*b*, the HDD 22, etc. An example of the sheet information for each of sheet sizes and sheet kinds is shown in Table 1.

TABLE 1

| Sheet size | Sheet kind | Thickness of on bundle of sheets | Thickness of a box |
|---|---|---|---|
| A4 | Regular | 100 mm | 400 mm |
| A4 | Thicker | 50 mm | 200 mm |
| B4 | Regular | 80 mm | 250 mm |
| B4 | Thicker | 30 mm | 200 mm |
| A3 | Regular | 50 mm | 200 mm |
| A3 | Thicker | 50 mm | 200 mm |

* Regular: regular sheet, Thicker: thicker sheet

Here, this example adopts the structure that user inputs the sheet information for each of sheet sizes and sheet kinds. However, in the case that the sheet information for each of sheet sizes and sheet kinds has been registered beforehand, this step can be omitted. Moreover, in the case that the computer terminal 30 is connected to the communication network, the sheet information can be set up on the browser of the computer terminal 30 by the use of the Web server function of the image forming apparatus 20. Also, the sheet information can be set up with MIB (Management Information Base) information disclosed by the image forming apparatus 20 through network application from the computer terminal 30.

Figure 12:
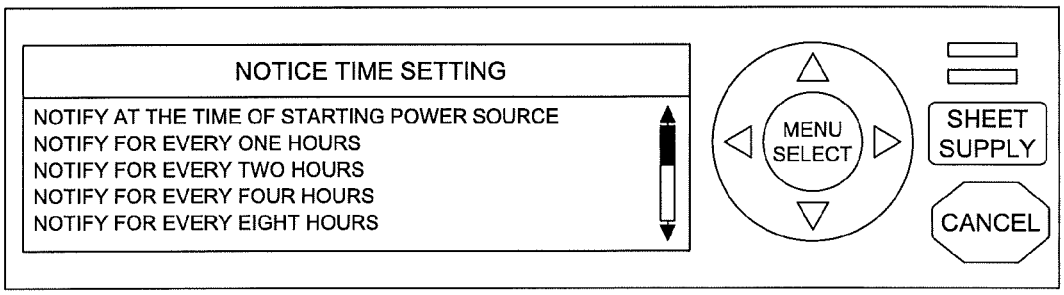
FIG. 12 is an illustration showing a structural example of a screen (notice time setting screen) displayed on a display operating section of an image forming apparatus according to the first embodiment of the present invention.

Next, if needed, the control section 21 makes the display operating section 23 to display a notice time setting screen 42 as shown in FIG. 12. This notice time setting screen 42 is provided with a column to set up time to notify that, for example, the sheet supply by one bundle of sheets as a unit of supply is possible. Therefore, a user can set up a notice time by operating the display operating section 23, and the control section 21 memorizes the notice time in the ROM 21*b*, the HDD 22, etc.

Next, at Step S102, the control section 21 discriminates the size and kind of sheets stored in each sheet tray 28, sets up the thickness of one bundle of sheets corresponding to each sheet tray on the basis of the sheet information of each sheet size and sheet kind set up by the above step, and memorizes the information in the ROM 21*b*, the HDD 22, etc. One example of the thickness of one bundle of sheets for each sheet tray is shown in Table 2.

TABLE 2

| Tray | Sheet size | Sheet kind | Thickness of one bundle of sheets |
|---|---|---|---|
| Tray 1 | A4 | Regular | 100 mm |
| Tray 2 | A4 | Regular | 100 mm |
| Tray 3 | A4 | Thicker | 50 mm |
| Tray 4 | B4 | Regular | 80 mm |
| Tray 5 | A3 | Regular | 50 mm |

Here, the sheet size can be discriminated from the location of a partition plate provided in the sheet tray 28 and the like, and the sheet kind can be discriminated from luminous intensity, a wavelength characteristic, and the like of light received by the capacity detecting section 29. Further, when a user inputs the sheet size and the sheet kind of each sheet tray 28 by operating the display operating section 23, the information can be utilized.

Next, at Step S103, the control section 21 forms an image based on a print job by controlling the image forming section 25, the printing department 26, and the sheet feeding section 27, conveys the sheet specified by the print job from the predetermined sheet tray 28, transfers the image onto the sheet, and outputs the sheet.

Next, at step S104, the capacity detecting section 28*a* (for example, a distance sensor) installed in each sheet tray 28 detects the capacity of empty space of each sheet tray 28, or the capacity of used sheets (referred to as a used capacity), and memorizes the information in the ROM 21*b*, the HDD 22, etc. In FIG. 5(*b*), the capacity of empty space can be calculated by subtracting the distance at the time of fully lading sheets from the distance at the time of currently loading sheets. Further, the used capacity can be obtained as a difference between the distance at the time of currently loading sheets and the distance at the time of the previous detection. In other words, the distance corresponding to a capacity of empty space correspond to a thickness of an amount of sheets capable of being stored in the capacity of empty space. One example of the capacity of empty space of each sheet tray 28 is shown in Table 3.

TABLE 3

| Tray | Sheet size | Sheet kind | Capacity of empty space |
|---|---|---|---|
| Tray 1 | A4 | Regular | 100 mm |
| Tray 2 | A4 | Regular | 25 mm |
| Tray 3 | A4 | Thicker | 10 mm |
| Tray 4 | B4 | Regular | 30 mm |
| Tray 5 | A3 | Regular | 20 mm |

Next, at step S105, the sheet managing section 24 (control program) reads out the thickness of one bundle of sheets memorized at step S102 and the capacity of empty space or the used capacity memorized at step S104 from the ROM 21*b*, the HDD22, etc, and compares the capacity of empty space or the used capacity with the thickness of one bundle of sheets for each sheet tray. Then, at Step S106, the sheet managing section 24 judges whether there is a sheet tray 28 in which the capacity of empty space or the used capacity becomes equal to or larger than the thickness of one bundle of sheets. When there is no sheet tray 28 which satisfies the above-mentioned condition, the operation returns to Step S103 and processes the following print job.

Figure 13:
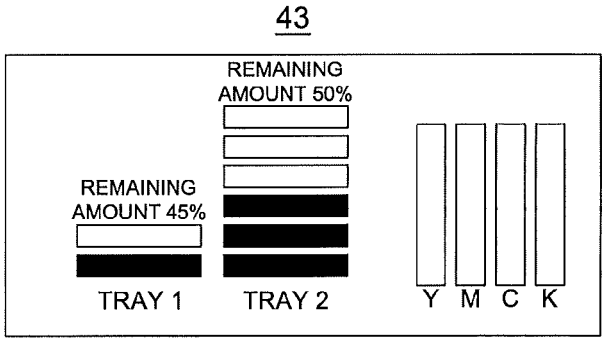
FIG. 13 is an illustration showing a structural example of a screen (sheet supply notifying screen) displayed on a display operating section of an image forming apparatus according to the first embodiment of the present invention.
Figure 14:
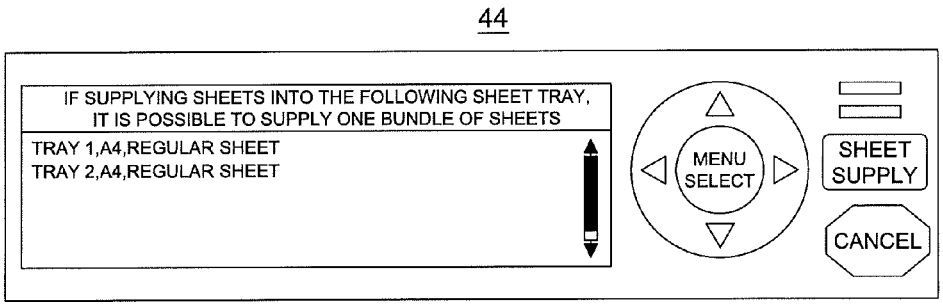
FIG. 14 is an illustration showing another structural example of a screen (sheet supply notifying screen) displayed on a display operating section of an image forming apparatus according to the first embodiment of the present invention.

On the other hand, when there is a sheet tray 28 which satisfies the above-mentioned condition, at Step S107, the sheet managing section 24 (control program) notifies that sheet supply is possible by one bundle of sheets as a unit of supply. This notifying method is not limited specifically. However, for example, as shown in FIG. 13, the condition of the sheet tray in which the sheet supply is possible can be displayed with a block corresponding to one bundle of sheets as a unit of supply, or as shown in FIG. 14, the condition can be displayed with a text message which designates a sheet tray in which a sheet supply is possible.

Here, the above example is structured such that, when sheet supply by one bundle of sheets as a unit of supply became possible, the above notice is issued. However, when a user opens one of the sheet trays 28, or when a user shows the intention to conduct a sheet supply by the image forming apparatus 20 or the computer terminal 30, the above notice can be also issued. Further, when the notice time is set up, the above notice can be structured to be issued at the set-up time.

Further, the above example is structured such that the situation that sheet supply can be conducted by one bundle of sheets as a unit of supply is notified on the screen. However, an E-mail (electronic mail) indicating the situation that sheet supply can be conducted by one bundle of sheets as a unit of supply can be transmitted to a computer terminal 30 connected to a communication network. In that case, it is preferable to designate a system administrator, an equipment administrator, and the like as the notice destination of the E-mail.

In the flow of FIG. 6, whether there is a capacity of empty space corresponding to one bundle of sheets is judged by detecting the thickness of sheets stacked in each sheet tray 28. However, since the control section 21 can recognize how many sheets were conveyed from which one of sheet trays 28 by each print job, whether there is a capacity of empty space corresponding to one bundle of sheets can be judged based on the quantity of sheets. The procedure in this case is explained with reference to the flow chart of FIG. 7.

[Flow in the Case of Judging the Propriety of Supply by One Bundle of Sheets as a Unit of Supply Based on the Number of Sheets]

First, at Step S201, the control section 21 makes the display operating section 23 to display a sheet information setting screen as same as the above flow. In this flow, the sheet information setting screen is provided with a column to input the number of sheets in one bundle of sheets and the number of sheets in one box for each of sheet sizes and sheet kinds. A user sets up sheet information, such as the number of sheets in one bundle of sheets for each of sheet sizes and sheet kinds by operating the display operating section 23. Then, the control section 21 memorizes the sheet information for each of sheet sizes and sheet kinds in the ROM 21*b*, the HDD 22, etc.

Next, if needed, the control section 21 makes the display operating section 23 to display a notice time setting screen 42. Then, a user sets up time to notify the situation that sheet supply can be conducted by one bundle of sheets as a unit of supply, and the control section 21 memorizes the notice time in the ROM 21*b*, the HDD 22, etc.

Next, at step S202, the control section 21 discriminates the sheet size and the sheet kind stored in each sheet tray 28, set up the number of sheets in one bundle of sheets corresponding to each sheet tray based on the sheet information for each of sheet sizes and sheet kinds set up in the above step, and memorizes the information in the ROM 21*b*, the HDD 22 and the like.

Next, at Step S203, the control section 21 processes a print job by controlling the image forming section 25, the printing section 26, and the sheet feeding section 27. Then, at Step S204, the control section 21 calculates the number of used sheets in each sheet tray 28 on the basis of the print job, and memorizes the information in the ROM 21*b*, the HDD 22, etc.

Next, at Step S205, the sheet managing section 24 (control program) reads out the number of sheets in one bundle of sheets memorized at step S202 and the number of used sheets memorized at Step S204 from the ROM 21*b*, the HDD 22, etc., and compares the number of used sheets with the number of sheets in one bundle of sheets for each sheet tray. Then, at step S206, the sheet managing section 24 judges whether there is a sheet tray 28 in which the number of used sheets becomes equal to or larger than the number of sheets in one bundle of sheets. As a result of the comparison, when there is no sheet tray 28 which satisfies the above-mentioned condition, the procedure returns to Step S203, and the following print job is processed.

On the other hand, when there is a sheet tray 28 which satisfies the above-mentioned condition, at Step S207, the sheet managing section 24 (control program) notifies that sheet supply by one bundle of sheets as a unit of supply is possible.

Here, as same as the above example, a timing to notify and a method of notifying are optional. For example, a notice can be issued at the time that a user opens a sheet tray, at the time that a user expresses the intention to conduct a sheet supply, at the time that time becomes a notice time. Further, a notice can be issued by E-mail.

Moreover, in the above example, during the time that the number of used sheets is being calculated, there is a possibility that a sheet tray is pulled out and some sheets are supplied in the sheet tray. Therefore, in the case of having detected that the sheet tray has been pulled out and has been inserted again, the detection of the number of sheets is changed to the detection by the above mentioned optical type distance sensor or after the number of sheets has been confirmed by the distance sensor, the detection is preferably returned again to the calculation of the number of used sheets.

Figure 7:
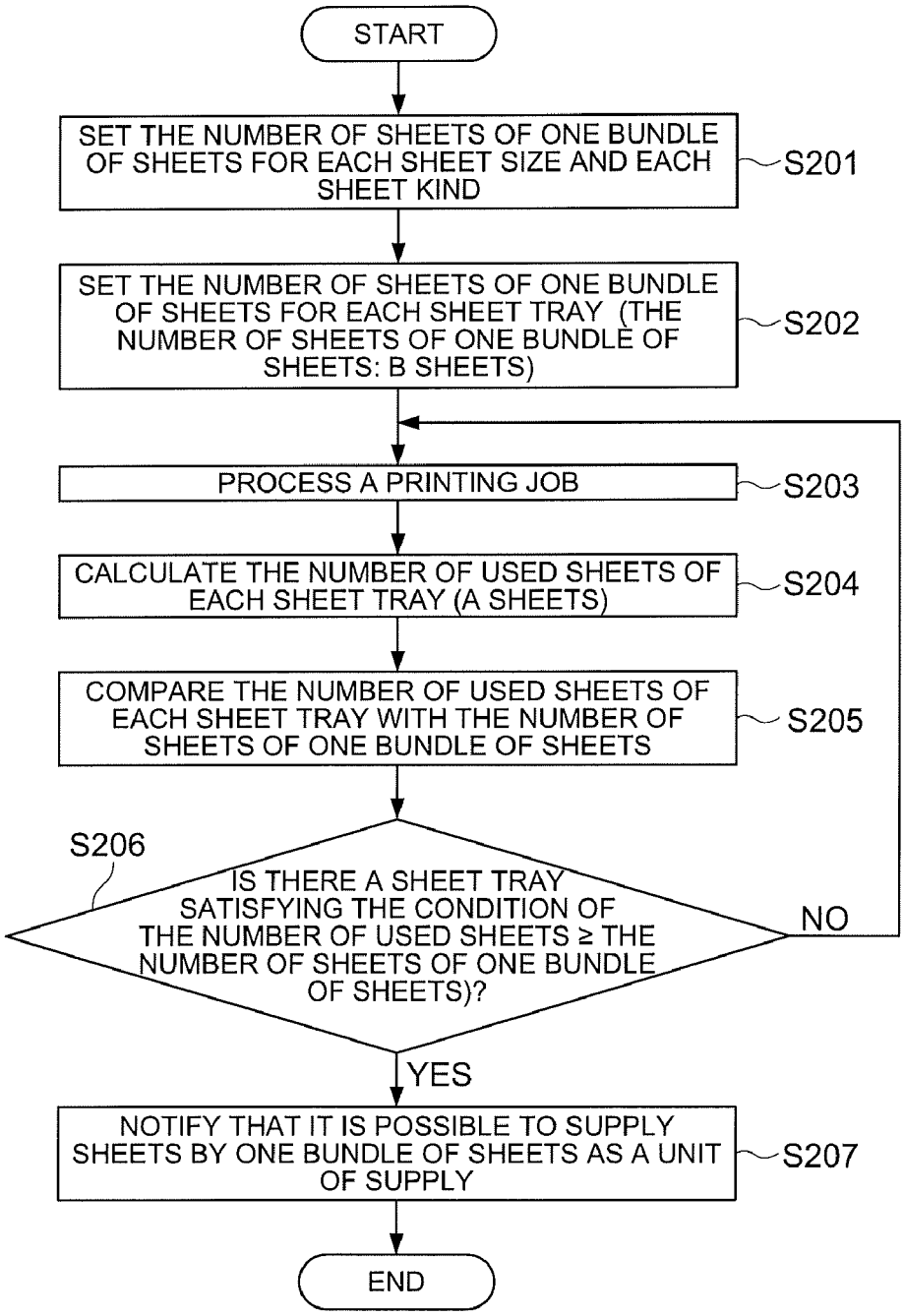
FIG. 7 is a flow chart showing the procedures of a sheet supply supporting method (in the case of judging the propriety of replenishment by one bundle of sheets as a unit of supply based on the number of sheets) according to the first embodiment of the present invention.

The flow of each of FIG. 6 and FIG. 7 is an example in the case of supplying sheets by one bundle of sheets as a unit of supply. However, in the case that the storage capacity of the sheet tray 28 is very large, it is also possible to supply sheets by plural bundles of sheets or by a box of sheets as a unit of supply. Therefore, from the view of working efficiency, there is a case preferable to notify at the time that sheet supply by plural bundles of sheets or by a box as a unit of supply became possible. The procedure in the above case is explained with reference to the flow chart of FIG. 8.

[Flow in the Case of Supplying Sheets by Plural Bundles of Sheets or by a Box of Sheets as a Unit of Supply]

First, at step S301, as same as the flow of FIG. 6, sheet information, such as the thickness of one bundle of sheets for each of sheet sizes and sheet kinds is set up, and if needed, time to notify the situation that sheet supply is possible is set up. Then, the information of these is memorized in the ROM 21*b*, the HDD 22, etc.

Figure 15:
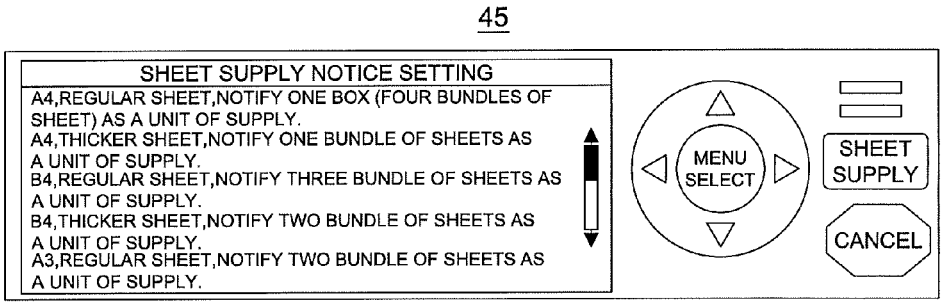
FIG. 15 is an illustration showing a structural example of a screen (sheet supply condition setting screen) displayed on a display operating section of an image forming apparatus according to the first embodiment of the present invention.

Next, at Step S302, the control section 21 makes the display operating section 23 to display a sheet supply condition setting screen 45 as shown in FIG. 15. The sheet supply condition setting screen 45 is provided with, for example, a column to set up a unit of sheet supply for each of sheet sizes and sheet kinds. A user sets up a unit of sheet supply for each of sheet sizes and sheet kinds by operating the display operating section 23, and the control section 21 memorizes the unit of sheet supply for each of sheet sizes and sheet kinds in the ROM 21*b*, the HDD 22, and the like.

Next, at Step S303, the control section 21 discriminates the sheet size and the sheet kinds stored in each sheet tray 28, thereafter, the control section 21 sets up the thickness of the desired amount of sheets as a unit of supply corresponding to each sheet tray 28 on the basis of the thickness of one bundle of sheets and the unit of sheet supply for each of sheet sizes and sheet kinds memorized in the ROM 21*b*, the HDD 22, and the like, and memorizes this information in the ROM 21*b*, the HDD 22, and the like.

Next, at Step S304, the control section 21 controls the image forming section 25, the printing department 26, and the sheet feeding section 27 so as to process a print job.

Next, at Step S305, the capacity detecting section 29 installed in each sheet tray 28 detects the capacity of empty space or the used capacity of each sheet tray 28, and memorizes the information in the ROM 21*b*, the HDD 22, and the like.

Next, at Step S306, the sheet managing section 24 (control program) reads out the thickness of the desired amount of sheets as a unit of supply memorized at step S303 and the capacity of empty space or the used capacity memorized at and step S304 from the ROM 21*b*, the HDD 22, and the like, and compares the capacity of empty space or the used capacity with the thickness of the desired amount of sheets as a unit of supply for each sheet tray. Then, at step S307, the sheet managing section 24 judges whether there is a sheet tray 28 in which the capacity of empty space or the used capacity has become equal to or larger than the thickness of the desired amount of sheets as a unit of supply. As a result of judgment, in the case that there is no sheet tray 28 which satisfies the above-mentioned condition, the procedure returns to Step S304 and the following print job is processed.

Figure 16:
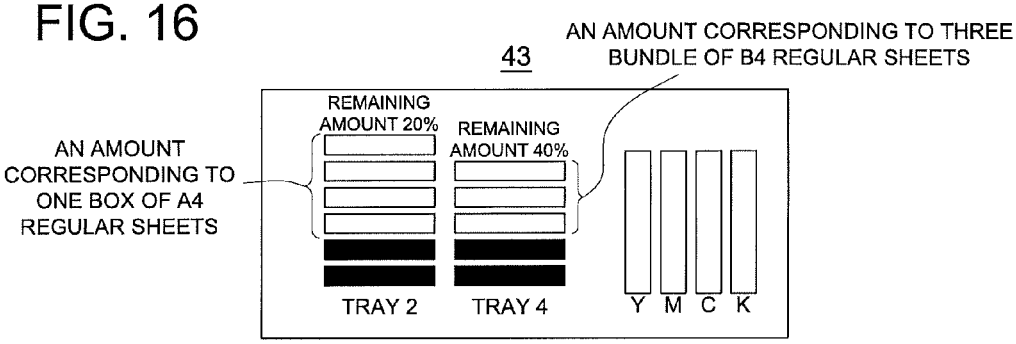
FIG. 16 is an illustration showing another structural example of a screen (sheet supply notifying screen) displayed on a display operating section of an image forming apparatus according to the first embodiment of the present invention.
Figure 17:
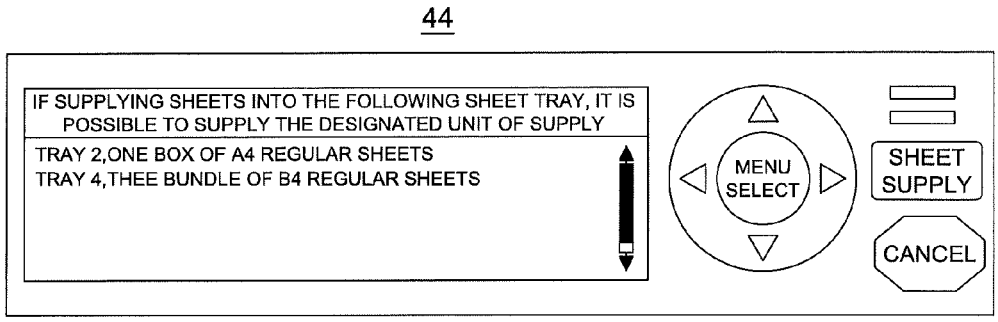
FIG. 17 is an illustration showing another structural example of a screen (sheet supply notifying screen) displayed on a display operating section of an image forming apparatus according to the first embodiment of the present invention.

On the other hand, in the case that there is a sheet tray 28 which satisfies the above-mentioned condition, at Step S308, the sheet management section 24 (control program) notifies that it is possible to supply sheets by the desired amount of sheets as a unit of supply. The notifying method is not limited specifically. However, for example, as shown in FIG. 16, the condition of the sheet tray in which sheet supply is possible is displayed with blocks with a unit of one bundle of sheets, whereby it is possible to indicate the situation that sheet supply can be conducted with a desired amount of sheets as a unit of supply. Also, as shown in FIG. 17, it is possible to indicate a message designating a sheet tray in which it is possible to supply sheets with the desired amount of sheets as a unit of supply.

Here, as same as the above example, a timing to notify and a method of notifying are optional. For example, a notice can be issued at the time that a user opens a sheet tray, at the time that a user expresses the intention to conduct sheet supply, and at the time that time becomes a notice time. Further, a notice can be issued by E-mail. Moreover, in this flow, the propriety of sheet supply is judged based on the capacity of sheets. However, as same as the flow of FIG. 7, the propriety of sheet supply can be judged based on the number of sheets.

Figure 8:
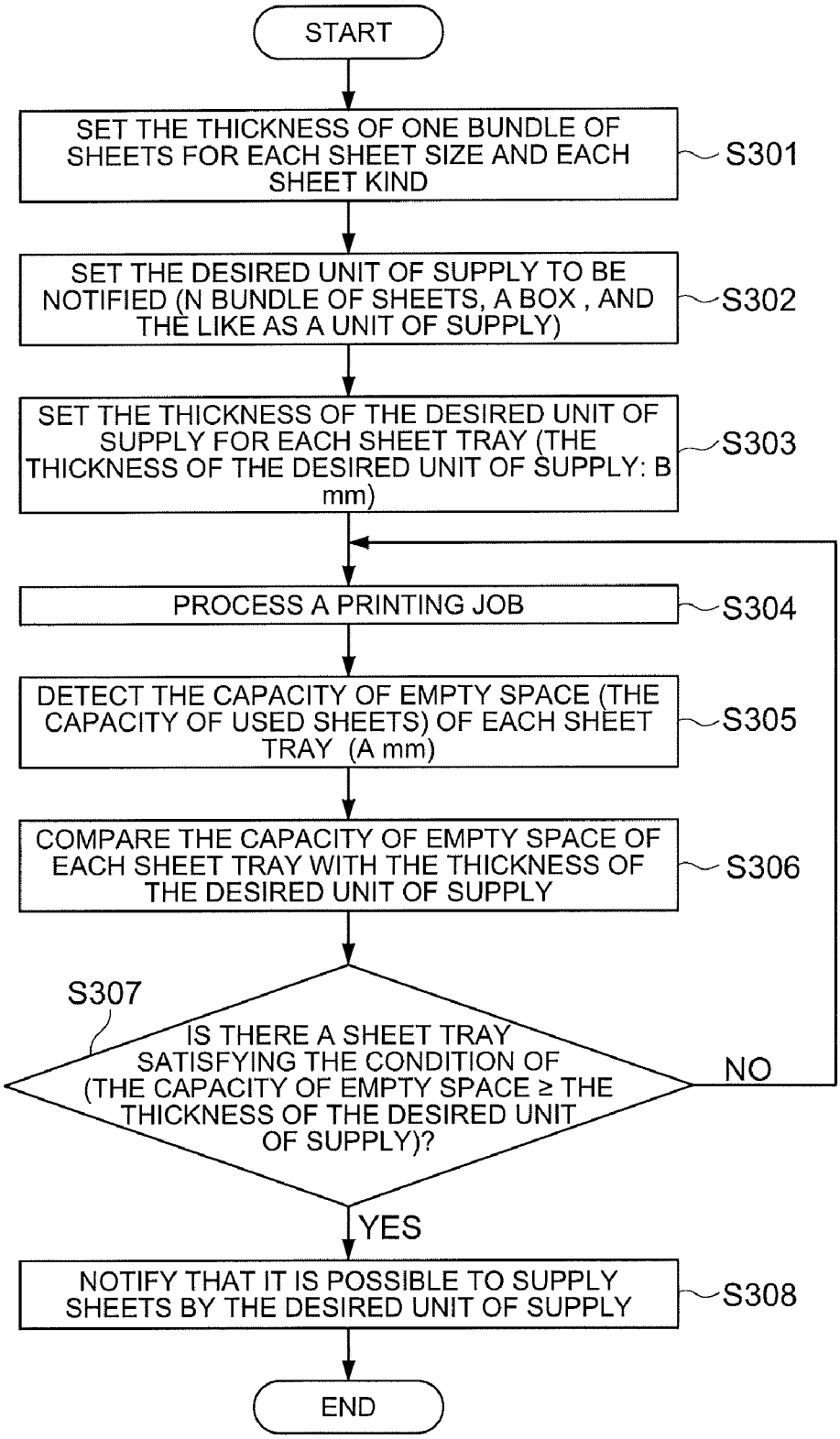
FIG. 8 is a flow chart diagram showing the procedures of the sheet supply supporting method (in the case of replenishing by the desired number of sheets as a unit of supply) according to the first embodiment of the present invention.

In the flows of FIGS. 6 through 8, the procedure is configured in such a manner that when the capacity of empty space corresponding to one bundle of sheets or a desired amount of sheets as a unit of supply takes place in one sheet tray 28, sheet supply is conducted. However, there is a case that sheets with the same size and the same kind are stored separately in plural sheet trays 28 (in this example, A4 regular size sheets are stored in the sheet tray 1 and the sheet tray 2. In this case, even when the capacity of empty space of one sheet tray 28 does not become to correspond to one bundle of sheets or a desired amount of sheets as a unit of supply, if the total capacity of the capacity of empty space of plural sheet trays 28 corresponds to one bundle of sheets or a desired amount of sheets as a unit of supply, sheets can be supplied by one bundle of sheets or a desired amount of sheets as a unit of supply.

Figure 9:
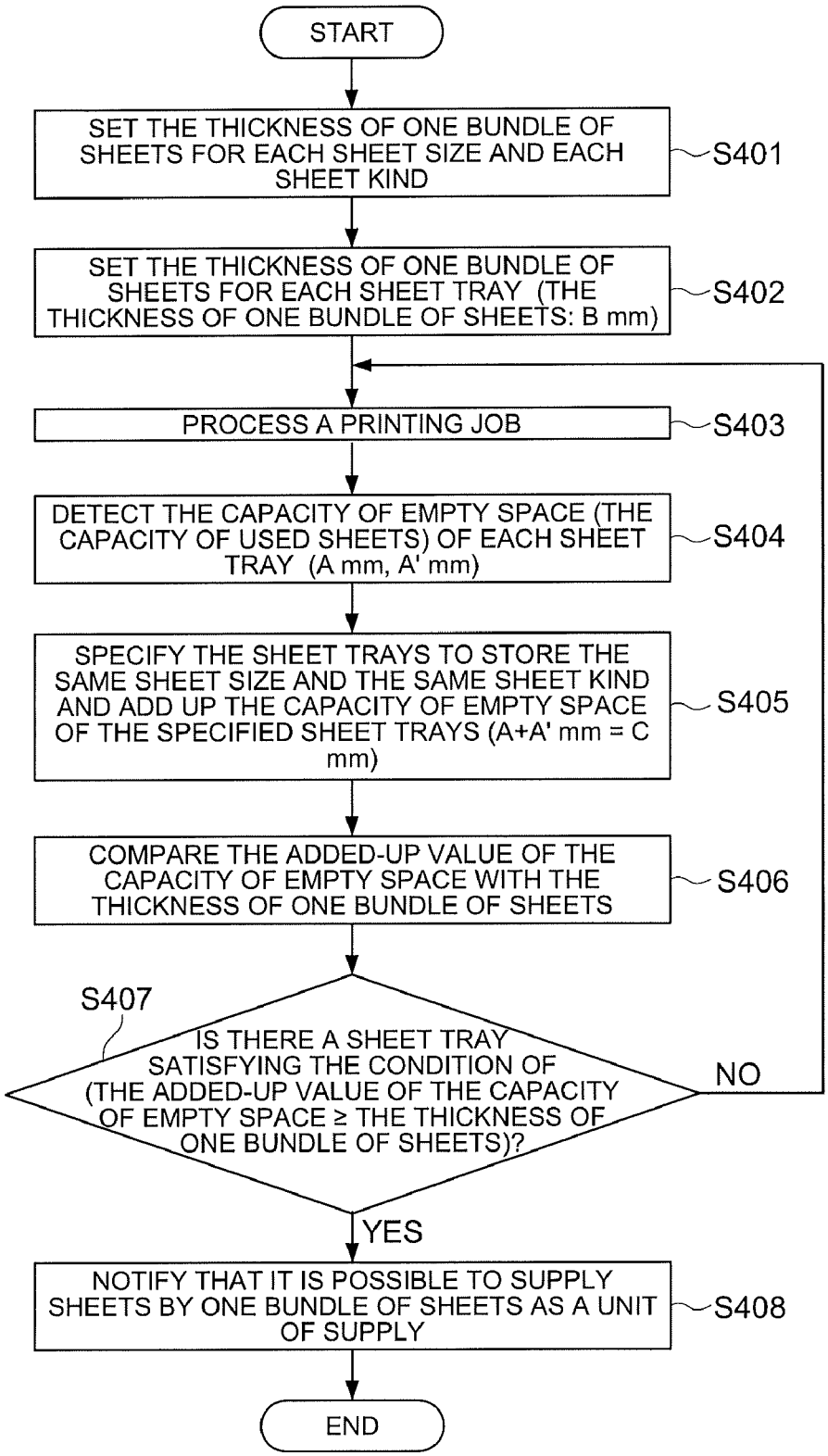
FIG. 9 is a flow chart diagram showing the procedures of the sheet supply supporting method (in the case of replenishing by one bundle of sheets as a unit of supply into plural trays) according to the first embodiment of the present invention.

The procedure in this case is explained with reference to the flow chart of FIG. 9.

[Flow in the Case of Supplying Sheets into Plural Sheet Trays by One Bundle of Sheets as a Unit of Supply]

First, as same as the flow of FIG. 6, at Step S401, sheet information, such as the thickness of one bundle of sheets, is set up for each sheet size and sheet kind, and if needed, the time to notify that sheet supply by one bundle of sheets as a unit of supply is possible is set up. Next, at step S402, the control section 21 discriminates the size and kind of sheets stored in each sheet tray 28, and sets up the thickness of one bundle of sheets corresponding to each sheet tray.

Next, at Step S403, the control section 21 controls the image forming section 25, the printing department 26, and the sheet feeding section 27 so as to process a print job. Next, at Step S404, the capacity detecting section 29 installed in each sheet tray 28 detects the capacity of empty space or the used capacity of each sheet tray, and memorizes the information in the ROM 21*b*, the HDD 22, and the like.

Next, at Step S405, the sheet managing section 24 (control program) specifies the sheet trays 28 which store the sheets of the same size and the same kind. Thereafter, the sheet managing section 24 adds up the capacity of empty space or the used capacity of the plural sheet trays 28 storing the sheets of the same size and the same kind by using the capacity of empty space or the used capacity of each sheet tray 28 memorized beforehand.

Table 4 shows a calculation example of the capacity of empty space for each sheet size and each sheet kind.

TABLE 4

| Sheet size | Sheet kind | Tray 1 | *Tray 2 | Tray 3 | Tray 4 | Tray 5 | Total |
|---|---|---|---|---|---|---|---|
| A4 | Reg | 20 mm | 25 mm | | | | 45 mm |
| A4 | Tkr | | | 10 mm | | | 10 mm |
| B4 | Reg | | | | 30 mm | | 30 mm |

TABLE 4-continued

| Sheet size | Sheet kind | Tray 1 | *Tray 2 | Tray 3 | Tray 4 | Tray 5 | Total |
|---|---|---|---|---|---|---|---|
| B4 | Tkr | | | | | | 0 mm |
| A3 | Reg | | | | | 20 mm | 20 mm |
| A3 | Tkr | | | | | | 0 mm |

*Reg: Regular sheet, Tkr: Thicker sheet
*Trays 1 through 5 are installed in Apparatus A Next, at Step S406, the sheet managing section 24 (control program) compares the total capacity of the capacity of empty space or the used capacity calculated by the above step with the thickness of one bundle of sheets memorized beforehand for each sheet size and each sheet kind. Then, at Step S407, the sheet managing section 24 judges whether there is any combination of the sheet trays 28 in which the total capacity of capacity of empty space or the used capacity becomes equal to or larger than the thickness of one bundle of sheets. As a result of the judgment, in the case that there is no combination of the sheet trays 28 which satisfies the above-mentioned condition, the procedure returns to Step S403 and the following print job is processed.

Figure 18:
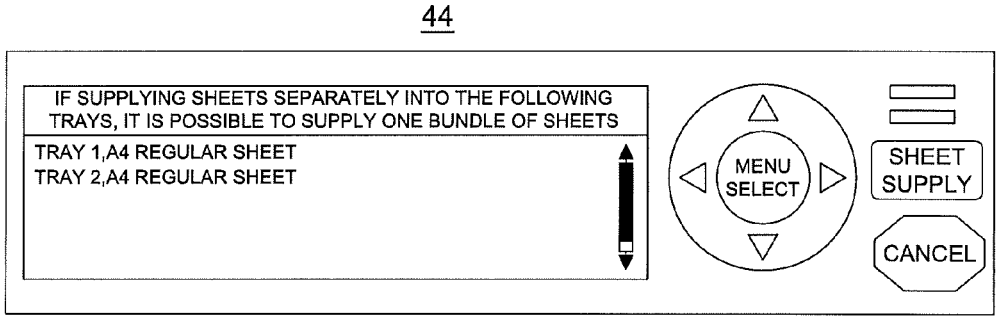
FIG. 18 is an illustration showing another structural example of a screen (sheet supply notifying screen) displayed on a display operating section of an image forming apparatus according to the first embodiment of the present invention.
Figure 19:
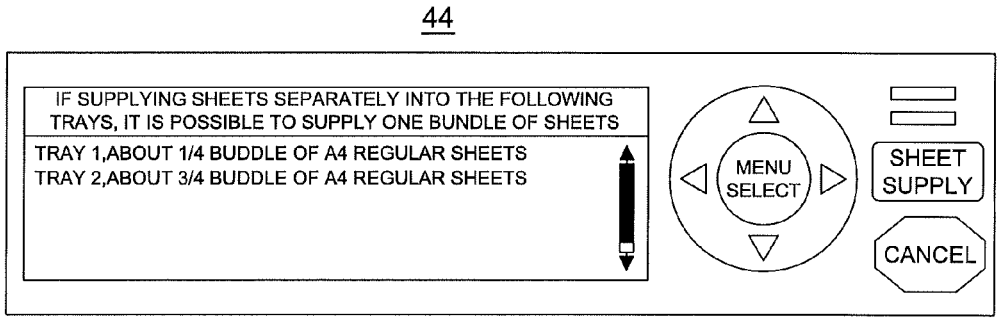
FIG. 19 is an illustration showing another structural example of a screen (sheet supply notifying screen) displayed on a display operating section of an image forming apparatus according to the first embodiment of the present invention.

On the other hand, when there is a combination of the sheet trays 28 which satisfies the above-mentioned condition, at Step S408, the sheet managing section 24 (control program) notifies that sheet supply is possible by one bundle of sheets as a unit of supply. The notifying method is not limited specifically. However, for example, as shown in FIG. 18, it is possible to indicate a combination of the sheet trays 28 (in the present example, Tray 1 and Tray 2 both storing the sheets of the same size and the same kind) in which sheet supply by one bundle of sheets as a unit of supply is possible. Further, in order to make it possible to recognize that there is how much capacity of empty space in each sheet tray 28, for example, as shown in FIG. 19, the sheet managing section 24 (control program) can indicate a combination of the sheet trays 28 in which sheet supply by one bundle of sheets as a unit of supply is possible and the rate of sheets capable of storing the sheets separately in the sheet trays 28.

Here, as same as the above example, a timing to notify and a method of notifying are optional. For example, a notice can be issued at the time that a user opens a sheet tray, at the time that a user expresses the intention to conduct sheet supply, and at the time that time becomes a notice time. Further, a notice can be issued by E-mail. Moreover, as same as the flow of FIG. 7, the propriety of sheet supply can be judged based on the number of sheets. Also, as same as the flow of FIG. 8, the procedure can be configured to judge whether sheets can be supplied by plural bundles of sheets or a box of sheets as a unit of supply.

The flows of FIGS. 6 through 9 indicate the case where sheets of the predetermined size and kind are stored in each sheet tray 28. However, the size of each sheet tray 28 is not constant, and the capacity of sheets and the number of sheets capable of being stored in each sheet tray is different from each other. In this case, for example, although the capacity of empty space of a sheet tray storing sheets of a certain size and kind has not become to correspond to the thickness of one bundle of sheets, if the sheets are shifted to another sheet tray, the capacity of empty space becomes to correspond to the thickness of one or more bundles of sheets.

Figure 10:
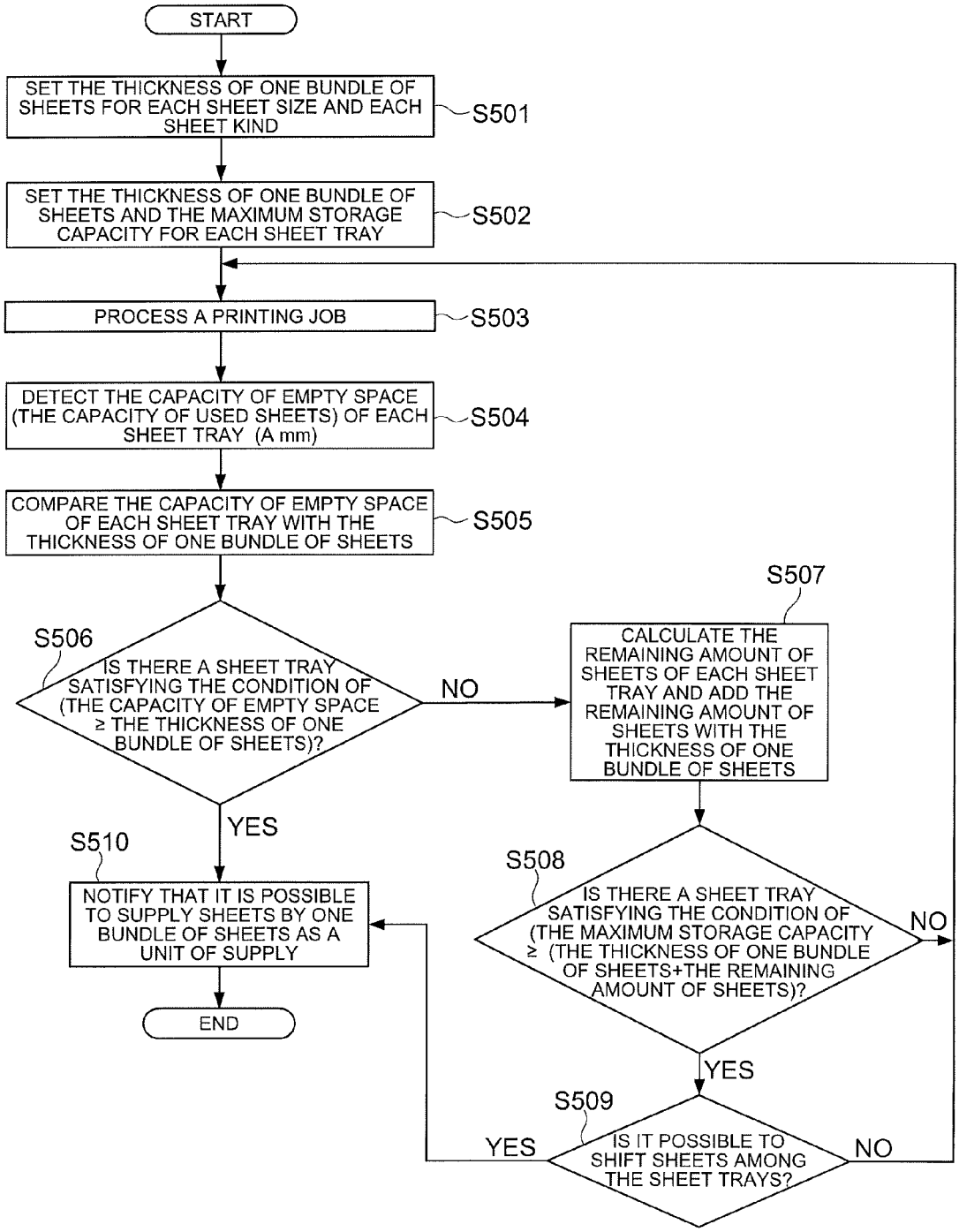
FIG. 10 is a flow chart diagram showing the procedures of the sheet supply supporting method (in the case of replenishing by one bundle of sheets as a unit of supply by shifting sheets among plural trays) according to the first embodiment of the present invention.

The procedure in this case is explained with reference to the flow chart of FIG. 10.

[Flow in the Case of Replacing Sheets Among Plural Sheet Trays and Supplying by One Bundle of Sheets as a Unit of Supply]

First, as same as the flow of FIG. 6, at Step S501, sheet information, such as the thickness of one bundle of sheets, is set up for each sheet size and sheet kind, and if needed, the time to notify that sheet supply by one bundle of sheets as a unit of supply is possible is set up. Next, at step S502, the control section 21 discriminates the size and kind of sheets stored in each sheet tray 28, and sets up the thickness of one bundle of sheets corresponding to each sheet tray. At this time, in this example, the maximum storage capacity of each sheet tray is also set up. Then, such information is memorized in the ROM 21*b*, the HDD 22, and the like.

Next, as same as the flow of FIG. 6, the processes at Steps S503 through S506 are conducted. Here, in the flow of FIG. 6, in the case that there is no sheet tray 28 having the capacity of empty space or the amount of used sheets equal to or larger than the thickness of one bundle of sheets, the following print job is processed. However, there is a case that if sheets are replaced among the plural sheet trays 28, the capacity of empty space or the amount of used sheets becomes equal to or larger than the thickness of one bundle of sheets.

Then, in this flow, in the case that there is no sheet tray 28 having the capacity of empty space or the amount of used sheets equal to or larger than the thickness of one bundle of sheets (in the case of "No" at Step S506), at step S507, the sheet managing section 24 (control program) calculates the quantity of remaining sheets remaining in each sheet tray 28, and adds this quantity of remaining sheets and the capacity of sheets of one bundle of sheets of the same sheet size and kind of the remaining sheets. In FIG. 5(*b*), this quantity of remaining sheets can be calculated by subtracting the distance at the time of loading current sheets from the distance at the time of loading no sheet.

Next, at Step S508, the sheet managing section 24 (control program) compares the maximum storage capacity of each sheet tray 28 with the added-up value (or total capacity) of the quantity (or capacity) of remaining sheets stored in other sheet trays and the capacity of one bundle of sheets.

Then, the sheet managing section 24 judges whether there is a sheet tray 28 having the maximum storage capacity equal to or larger than the added-up value (total capacity) of the quantity of remaining sheets and the capacity of one bundle of sheets. As a result of the comparison, when there is no sheet tray 28 which satisfies the above-mentioned condition, the procedure returns to Step S503, and the following print job is processed.

On the other hand, when there is a sheet tray 28 which satisfies the above-mentioned condition, at Step S509, the sheet managing section 24 (control program) compares the quantity of remaining sheets stored in the sheet tray 28 (referred to as a shift destination sheet tray, or a replacement destination sheet tray) with the maximum storage capacity of the sheet tray 28 (referred to as a shift source sheet tray, or a replacement source sheet tray) which stores the sheets used for the calculation of the above added-up value, and judges whether sheet shifting (replacing) among the sheet trays 28 is possible.

Then, if the maximum storage capacity of the sheet tray 28 (shift source sheet tray) is smaller than the quantity of remaining sheets stored in the tray (shift destination sheet tray), the sheet managing section 24 judges that the sheet shifting cannot be conducted, the procedure returns to Step S503, and the following print job is processed. On the other hand, if the maximum storage capacity of the sheet tray 28 (shift source sheet tray) is equal to or larger than the quantity of remaining sheets stored in the tray (shift destination sheet tray), the sheet managing section 24 judges that the sheet shifting is possible and the procedure proceeds to Step S510.

The processes of the above Steps S508 and S509 are now shown concretely. For example, as shown in Table 5, the following conditions are assumed. That is, the maximum storage capacities of Sheet tray 1 (the above-mentioned shift source sheet tray) is 250 sheets (conversion value based on regular sheet), 100 sheets of A4 regular sheets are currently stored in Sheet tray 1, the maximum storage capacities of Sheet tray 2 (the above-mentioned shift destination sheet tray) is 1000 sheets (conversion value based on regular sheet), and 150 sheets of A5 regular sheets are currently stored in Sheet tray 2. Further, the number of sheets of one bundle of A4 regular sheets is 500 sheets and the thickness of a regular sheet is constant regardless of sheet size.

TABLE 5

| Tray | Tray 1 | Tray 2 | | Tray 1 | Tray 2 |
|---|---|---|---|---|---|
| Sheet information | A4 Regular sheet longitudinal | A5 Regular sheet longitudinal | → | A5 Regular sheet longitudinal | A4 Regular sheet longitudinal |
| Maximum storage capacity | 250 sheets | 1000 sheets | | 250 sheets | 1000 sheets |
| Amount of remaining sheets | 100 sheets | 150 sheets | | 150 sheets | 100 sheets + 500 sheets (one bundle) |

In the above conditions, if one bundle of A4 regular sheets is stored in Sheet tray 1 (the first sheet tray, shift source sheet tray), the added-up value (total capacity) of the quantity of remaining sheets (100 sheets) and the capacity of one bundle of sheets (500 sheets) becomes 600 sheets. Therefore, the added-up value exceeds the maximum storage capacity (250 sheets) of Sheet tray 1. On the other hand, since the maximum storage capacity of Sheet tray 2 (the second sheet tray, shift destination sheet tray) is 1000 sheets, the maximum storage capacity is larger than the added-up value of 600 sheets. Therefore, if the A4 regular sheets stored in Sheet tray 1 are shifted to Sheet tray 2, one bundle of A4 regular sheets can be supplied into Sheet tray 2.

In this case, since it becomes necessary to shift the A5 regular sheets stored in Sheet tray 2 to Sheet tray 1, the sheet managing section 24 judges whether the A5 regular sheets can be stores in Sheet tray 1. Here, the quantity of the remaining A5 regular sheets is 150 sheets, and the maximum storage capacity of Sheet tray 1 is 250 sheets. Therefore, the A5 regular sheets can be shifted to Sheet tray 1. As a result, in the above conditions, the A4 regular sheets stored in Sheet tray 1 and the A5 regular sheets stored in Sheet tray 2 can be replaced with each other.

Figure 20:
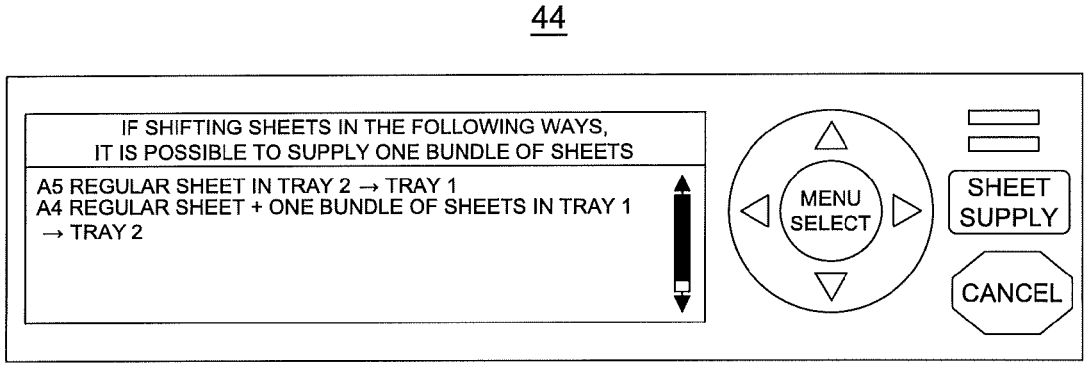
FIG. 20 is an illustration showing another structural example of a screen (sheet supply notifying screen) displayed on a display operating section of an image forming apparatus according to the first embodiment of the present invention.

Then, at Step S510, the sheet managing section 24 (control program) notifies that sheet supply of one bundle of sheets as a unit of supply is possible. The notifying method is not limited specifically. However, in the case that sheet supply by one bundle of sheets becomes possible by replacing sheets among the plural sheet trays 28 (in the case that Step S509 is "Yes"), for example, as shown in FIG. 20, sheet trays of "shift source" and "shift destination" and "size" and "kind" of sheets to be shifted can be displayed.

Here, as same as the above example, a timing to notify and a method of notifying are optional. For example, a notice can be issued at the time that a user opens a sheet tray, at the time that a user expresses the intention to conduct sheet supply, and at the time that time becomes a notice time. Further, a notice can be issued by E-mail. Moreover, as same as the flow of FIG. 7, the propriety of sheet supply can be judged based on the number of sheets. Also, as same as the flow of FIG. 8, the procedure can be configured to judge whether sheets can be supplied by a plural bundle of sheets or a box of sheets as a unit of supply.

Furthermore, in each of above flows, whether sheet supply can be conducted by one or plural bundles of sheets as a unit of supply is judged after processing a print job (in other words, when the capacity of empty space of any one of sheet trays changes). However, the judging timing is not necessarily limited to "after processing a print job". The procedures can be configured in such a way that the judging is conducted at the time that a user opens a sheet tray, at the time that a user expresses the intention to conduct sheet supply, and at the time that time becomes a preset notice time.

Embodiment 2

Figure 21:
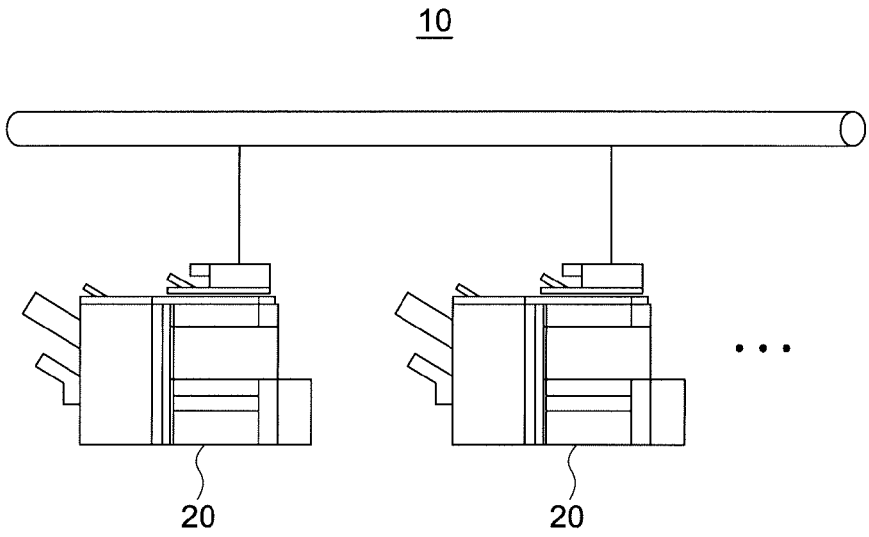
FIG. 21 is a schematic illustration showing a structure of a printing system according to the second embodiment of the present invention.
Figure 22:
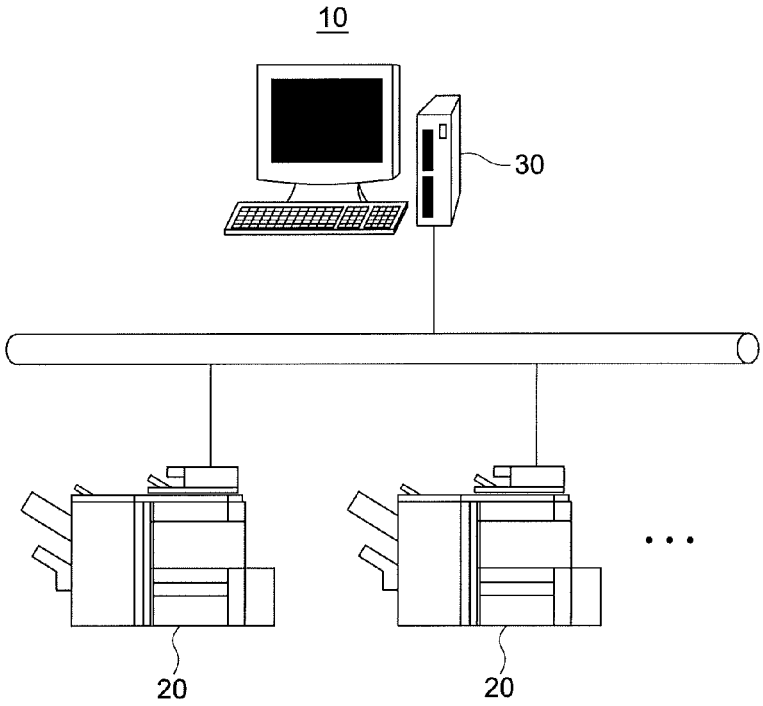
FIG. 22 is a schematic illustration showing another structure of a printing system according to the second embodiment of the present invention.
Figure 23:
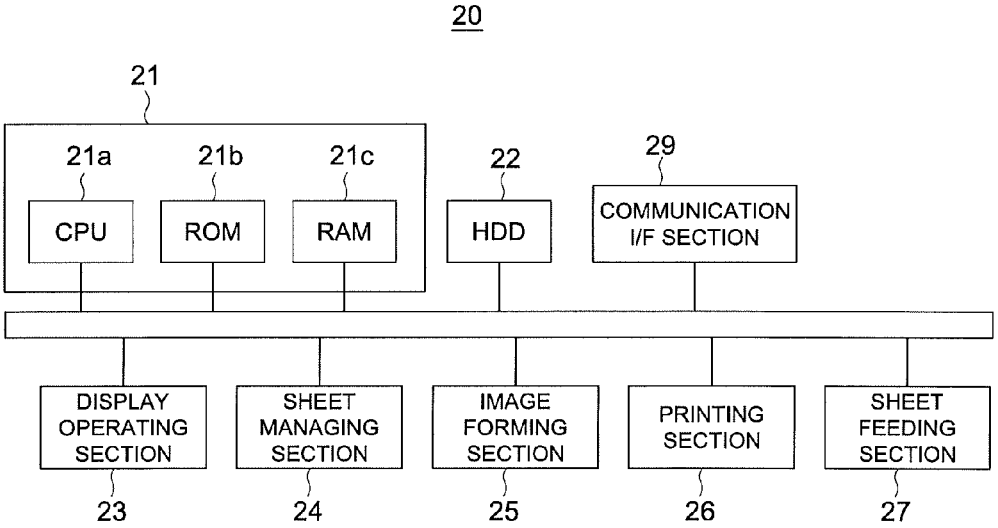
FIG. 23 is a block diagram showing a structure of an image forming apparatus according to the second embodiment of the present invention.
Figure 24:
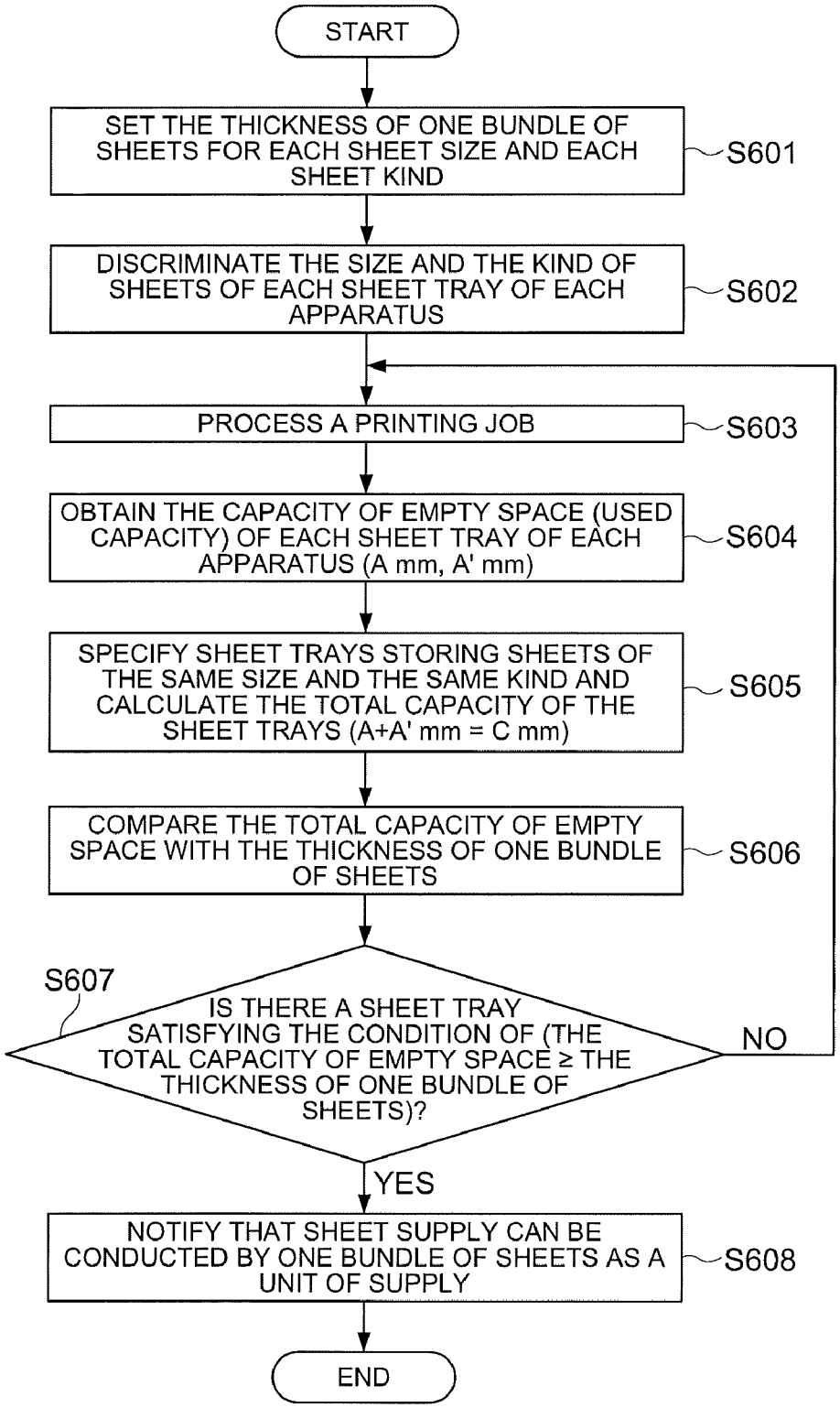
FIG. 24 is a flow chart showing the procedures of a sheet supply supporting method (in the case of supplying sheets by one bundle as a unit of supply into plural trays of plural image forming apparatuses) according to the second embodiment of the present invention.
Figure 25:
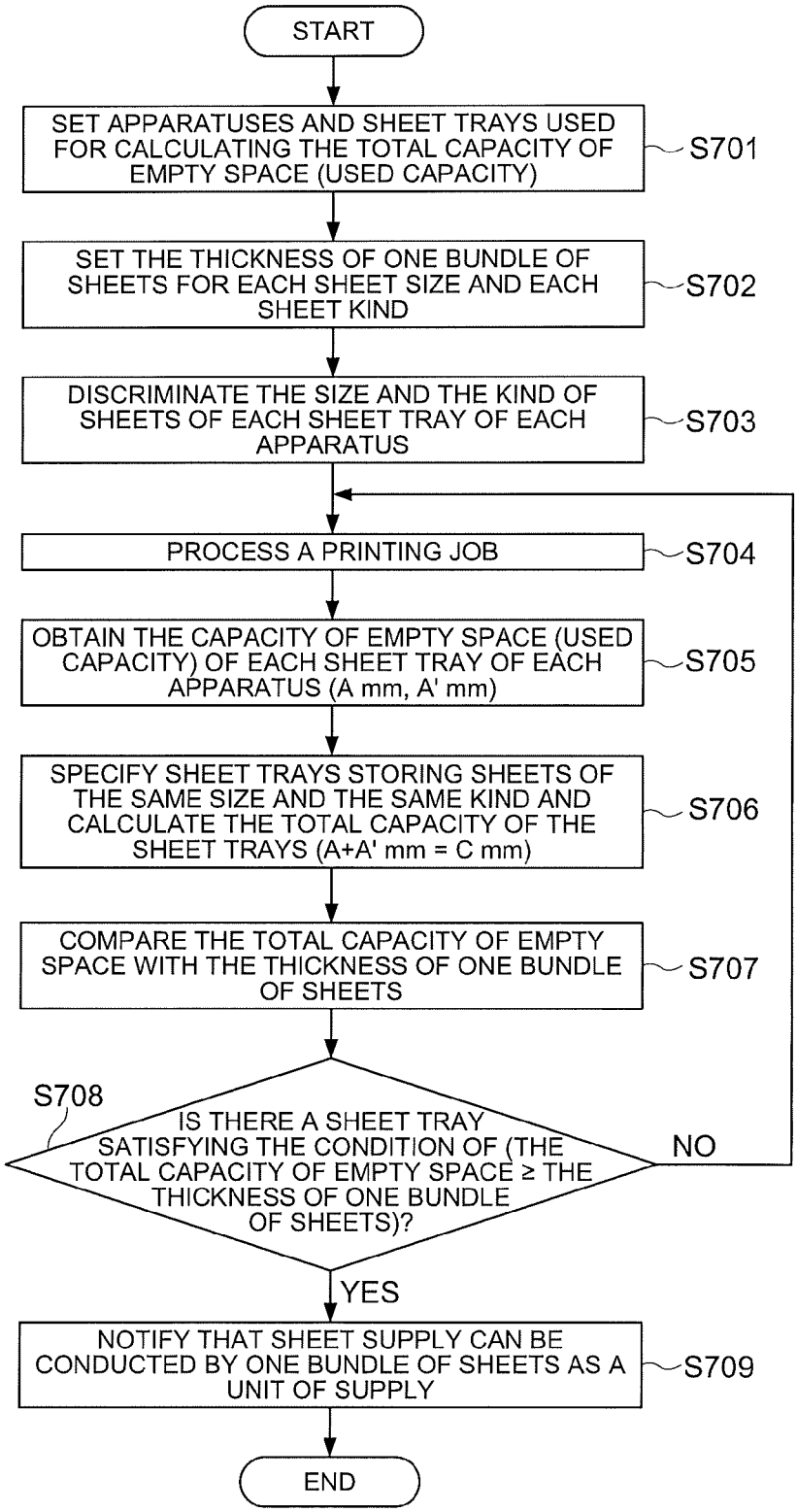
FIG. 25 is a flow chart showing the procedures of a sheet supply supporting method (in the case of supplying sheets by one bundle as a unit of supply into plural trays of selected image forming apparatuses) according to the second embodiment of the present invention.

Next, a printing system, sheet supply supporting method, and control program according to the second embodiment of the present invention will be explained with reference to FIGS. 21 through 28. FIGS. 21 and 22 are a schematic illustration showing a structure of a printing system of this embodiment, and FIG. 23 is a block diagram showing a structure of an image forming apparatus of this embodiment. Further, FIGS. 24 and 25 are flow charts showing operations of the image forming apparatus of this embodiment, and FIGS. 26 through 28 each is an illustration showing an example of a screen displayed on a display operating section of an image forming apparatus.

Although the above mentioned first embodiment is described in the case that the printing system 10 is equipped with one set of the image forming apparatus 20, this embodiment is explained about the case where the printing system 10 is equipped with plural sets of the image forming apparatuses 20.

As shown in FIG. 21, the printing system 10 of this embodiment is constituted such that plural image forming apparatuses 20 are connected through a communication network.

The basic structure of each of the plural image forming apparatuses 20 is the same as that of the first embodiment. However, in this embodiment, since it is necessary to share information on sheet trays among the image forming apparatuses 20, as shown in FIG. 23, each of the image forming apparatuses 20 is provided with a communication I/F section 29 to communicate with other image forming apparatuses 20 in addition to the structure of FIG. 3.

Further, a sheet managing section 24 obtains the capacity of empty space (an amount of sheets capable of being stored) of each sheet tray of each image forming apparatus 20, compare the capacity of empty space of each sheet tray or the total capacity of empty space of sheet trays storing sheets of the same size and the same kind calculated for each sheet size and each sheet kind with the capacity of sheets of a desired amount of sheets (one bundle of sheets, plural bundle of sheets or a box of sheets) as a unit of sheet supply, and, in the case that the capacity of empty space is equal to or larger than the desired amount of sheets as a unit of sheet supply, notifies that it becomes possible to supply sheets by the desired amount of sheets as a unit of sheet supply.

This sheet managing section 24 can be constituted as hardware in the image forming apparatus 20. Also, the sheet managing section 24 can be constituted as a control program to make a computer to act as the sheet managing section 24, and this control program can be constituted to work on the control section 21. Further, the sheet managing section 24 can be provided to at least one image forming apparatus 20. Moreover, as shown in FIG. 22, the printing system 10 can be constituted such that a computer terminal 30 such as a printer controller and a client is connected to plural image forming apparatuses 20 through a communication network. In this case, the sheet managing section 24 can be provided to one of the image forming apparatuses 20 or to the computer terminal 30 as hardware or software.

The sheet supply supporting method in the printing system 10 of the above structure will be explained.

Even in the printing system 10 of this embodiment, there is a case that sheets of the same size and the same kind are stored in plural sheet trays 28 of plural image forming apparatuses 20. In this case, even if the capacity of empty space of one sheet tray 28 does not become to correspond to the capacity of the desired amount of sheets or one bundle of sheets as a unit of sheet supply, If the total capacity of the capacity of empty space of plural sheet trays 28 of plural image forming apparatus 20 becomes to correspond to the capacity of the desired amount of sheets or one bundle of sheets as a unit of sheet supply, it is possible to supply sheets by one bundle of sheets or the desired amount of sheets as a unit of sheet supply.

The procedures in this case will be explained with reference to the flow chart of FIG. 24.

[Flow in the Case of Supplying Sheets to Plural Sheet Trays of Plural Image Forming Apparatuses by One Bundle of Sheets as a Unit of Sheet Supply]

First, at Step S601, a control section 21 of an image forming apparatus 20 (referred to as a specific image forming apparatus 20) performing a sheet supply supporting technique of this embodiment indicates a sheet information setting screen 41 as shown in FIG. 11 at a display operating section 23 as same as the first embodiment. Then, a user sets up sheet information, such as the thickness of one bundle of sheets for each sheet size and each sheet kind by operating the display operating section 23, and the control section 21 memorizes the sheet information of each sheet size and each sheet kind in the ROM 21*b*, the HDD 22, etc.

Here, this example adopts the structure that user inputs the sheet information for each sheet size and each sheet kind. However, in the case that the sheet information for each sheet size and each sheet kind is registered beforehand, this step can be omitted. Moreover, in the case that the computer terminal 30 is connected to the communication network, the sheet information can be set up on the browser of the computer terminal 30 by the use of the Web server function of the specific image forming apparatus 20. Also, the sheet information can be set up with MIB (Management Information Base) information disclosed by the specific image forming apparatus 20 through network application from the computer terminal 30.

Next, if needed, the control section 21 of the specific image forming apparatus makes the display operating section 23 to display the notice time setting screen 42 as shown in FIG. 12 as same as the first embodiment. Then, a user sets up a notice time by operating the display operating section 23, and the control section 21 memorizes the notice time in the ROM 21*b*, the HDD 22, etc.

Next, at Step S602, the control section 21 of the specific image forming apparatus 20 discriminates the size and kind of sheets stored in each sheet tray 28. Further, from the other image forming apparatuses 20, the control section 21 of the specific image forming apparatus 20 obtains information to discriminate the size and kind of sheets stored in each sheet tray 28 of the other image forming apparatuses 20 through the communication I/F section 29. At this time, the control section 21 of the specific image forming apparatus 20 obtains information about the installed location of the other image forming apparatuses 20 and the like, if needed. Then, the information is stored in the ROM 21*b*, the HDD 22, etc.

Here, the sheet size can be discriminated from the location of a partition plate provided in the sheet tray 28 and the like, and the sheet kind can be discriminated from luminous intensity, a wavelength characteristic, and the like of light received by the capacity detecting section 28*a*. Further, when a user inputs the sheet size and the sheet kind of each sheet tray 28 of each image forming apparatus 20 by operating the display operating section 23, the information can be utilized.

Next, at Step S603, the control section 21 of one of the image forming apparatuses 20 forms an image based on a print job by controlling the image forming section 25, the printing department 26, and the sheet feeding section 27 of the image forming apparatus 20, conveys the sheet specified by the print job from the predetermined sheet tray 28, transfers the image onto the sheet, and outputs the sheet.

Next, at step S604, the capacity detecting section 28*a* (for example, a distance sensor) installed in each sheet tray 28 of the specific image forming apparatus 20 detects the capacity of empty space or the used capacity (the capacity of used sheets) of each sheet tray 28. Further, from the other image forming apparatuses 20, the control section 21 of the specific image forming apparatuses 20 obtains the capacity of empty space or the used capacity of each sheet tray 28 of the other image forming apparatuses 20, and memorizes the capacity of empty space or the used capacity of each sheet tray 28 of the other image forming apparatuses 20 together with the capacity of empty space or the used capacity detected in itself in the ROM 21*b*, the HDD 22 and the like. One example of the capacity of empty space of each sheet tray 28 of each image forming apparatus (here, image forming apparatuses A through D) is shown in Tables 6 through 9.

TABLE 6

| Apparatus A | | | |
|---|---|---|---|
| Tray | Sheet size | Sheet kind | Capacity of empty space |
| Tray 1 | A4 | Regular | 20 mm |
| Tray 2 | A4 | Regular | 25 mm |
| Tray 3 | A4 | Thicker | 10 mm |
| Tray 4 | B4 | Regular | 30 mm |
| Tray 5 | A3 | Regular | 20 mm |

Regular: Regular sheet,
Thicker: Thicker sheet

TABLE 7

| Apparatus B | | | |
|---|---|---|---|
| Tray | Sheet size | Sheet kind | Capacity of empty space |
| Tray 1 | A4 | Regular | 30 mm |
| Tray 2 | B4 | Regular | 10 mm |
| Tray 3 | A3 | Regular | 10 mm |

TABLE 8

| Apparatus C | | | |
|---|---|---|---|
| Tray | Sheet size | Sheet kind | Capacity of empty space |
| Tray 1 | A4 | Regular | 15 mm |
| Tray 2 | A4 | Thicker | 25 mm |

TABLE 9

| Apparatus D | | | |
|---|---|---|---|
| Tray | Sheet size | Sheet kind | Capacity of empty space |
| Tray 1 | A4 | Regular | 20 mm |
| Tray 2 | B4 | Regular | 25 mm |
| Tray 3 | B4 | Thicker | 10 mm |
| Tray 4 | A3 | Regular | 30 mm |
| Tray 5 | A3 | Thicker | 20 mm |

Next, at Step S605, the sheet managing section 24 (control program) of the specific image forming apparatus 20 specifies the sheet trays 28 which store the sheets of the same size and the same kind on the basis of the information memorized at Step S602. Thereafter, the sheet managing section 24 adds up the capacity of empty space or the capacity of used sheets of the plural sheet trays 28 of the plural image forming apparatuses 20 storing the sheets of the same size and the same kind by using the capacity of empty space or the capacity of used sheets of each sheet tray 28 memorized at Step S604.

Table 10 shows a calculation example of the capacity of empty space for each sheet size and each sheet kind.

Next, at step S606, the sheet managing section 24 (control program) of the specific image forming apparatus compares the total capacity of the capacity of empty space or the capacity of used sheets calculated by the above step with the thickness of one bundle of sheet memorized at Step S601 for each sheet size and each sheet kind. Then, at Step S607, the sheet managing section 24 judges whether there is any combination of the sheet trays 28 in which the total capacity of the capacity of empty space or the capacity of used sheets becomes equal to or larger than the thickness of one bundle of sheets. As a result of the judgment, in the case that there is no combination of the sheet trays 28 which satisfies the above-mentioned condition, the procedure returns to Step S603 and the following print job is processed.

On the other hand, when there is a combination of the sheet trays 28 which satisfies the above-mentioned condition, at Step S608, the sheet managing section 24 (control program) notifies that it is possible to supply sheets by one bundle of sheets as a unit of supply by distributing the sheets to the plural sheet trays 28 of the plural image forming apparatuses 20.

Figure 26:
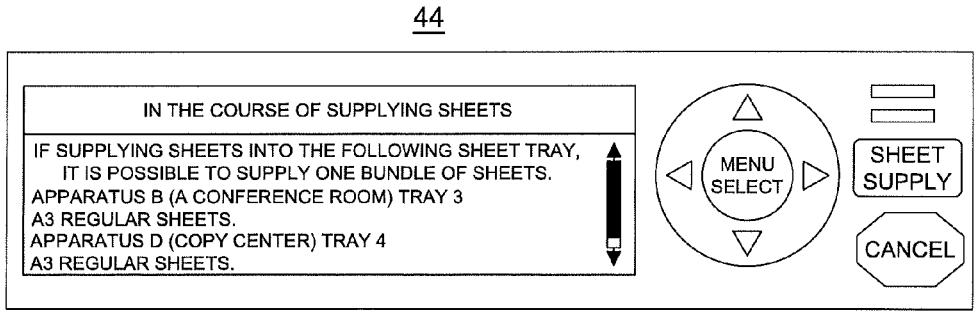
FIG. 26 is an illustration showing a structural example of a screen (sheet supply notifying screen) displayed on a display operating section of an image forming apparatus according to the second embodiment of the present invention.
Figure 27:
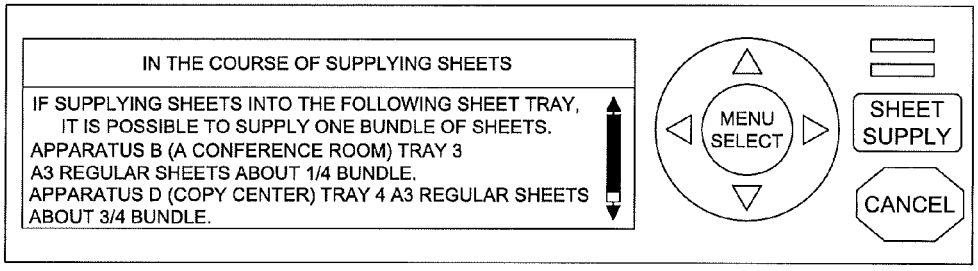
FIG. 27 is an illustration showing another structural example of a screen (sheet supply notifying screen) displayed on a display operating section of an image forming apparatus according to the second embodiment of the present invention.

The notifying method is not limited specifically. However, for example, as shown in FIG. 26, it is possible to indicate a combination of the sheet trays 28 (in the present example, tray 3 of the apparatus B and tray 4 of the apparatus D both storing A3 size regular sheets) in which sheet supply by one bundle of sheets as a unit of supply is possible. Further, in order to make it possible to recognize that there is how much capacity of empty space in each sheet tray 28, for example, as shown in FIG. 27, the sheet managing section 24 (control program) of the specific image forming apparatus 20 can indicate a combination of the sheet trays 28 in which sheet supply by one bundle of sheets as a unit of supply is possible and the rate (distributing rate) of sheets for storing the sheets separately into the sheet trays 28. Further, when there are plural combinations of the sheet trays 28, all the combinations of the sheet trays 28 can be indicated. Also, in this case, based on the previously obtained information about the installed locations, it is preferable to indicate a combination of sheet trays with which the distribution supply of the sheets can be conducted easily, for example, a combination of sheet trays of the image forming apparatuses 20 located close to each other. Moreover, a notice that it is possible to supply sheets by one bundle of sheets as a unit of sheet supply, can be notified to not only

TABLE 10

| Result of calculation | | | | | | | | | | | | | | | | | |
|---|---|---|---|---|---|---|---|---|---|---|---|---|---|---|---|---|---|
| Sheet size | Sheet kind | A1 | A2 | A3 | A4 | A5 | B1 | B2 | B3 | C1 | C2 | D1 | D2 | D3 | D4 | D5 | Total |
| A4 | Regular sheet | 20 mm | 25 mm | | | | 30 mm | | | 15 mm | | 20 mm | | | | | 110 mm |
| A4 | Thicker sheet | | | 10 mm | | | | | | | 25 mm | | | | | | 35 mm |
| B4 | Regular sheet | | | | 30 mm | | | 10 mm | | | | | 25 mm | | | | 65 mm |
| B4 | Thicker sheet | | | | | | | | | | | | | 10 mm | | | 10 mm |
| A3 | Regular sheet | | | | | 20 mm | | | 10 mm | | | | | | 30 mm | | 60 mm |
| A3 | Thicker sheet | | | | | | | | | | | | | | | 20 mm | 20 mm |

A: Apparatus A Tray,
B: Apparatus B Tray,
C: Apparatus C Tray,
D: Apparatus D Tray the specific image forming apparatus 20, but also to other image forming apparatuses 20 and the computer terminal 30.

Here, as same as the first embodiment, a timing to notify and a method of notifying are optional. For example, a notice can be issued at the time that a user opens a sheet tray 28 of any one of the image forming apparatuses 20, at the time that a user expresses the intention to conduct sheet supply at any one of the image forming apparatuses 20, and at the time that time becomes a notice time. Further, a notice can be issued by E-mail. Moreover, as same as the first embodiment, the propriety of sheet supply can be judged based on the number of sheets. Also, the procedure can be configured to judge whether sheet supply can be conducted by plural bundles of sheets or a box of sheets as a unit of supply.

The above flow is aimed at all the sheet trays 28 of all the image forming apparatuses 20 connected to the communication network. However, in the case that the scale of the printing system 10 is very large, the number of the combinations of the sheet tray 28 satisfying the condition increases more, and the judgment of sheet supply becomes difficult. Further, in the case that the predetermined image forming apparatus 20 is installed at the location far away from other image forming apparatuses 20, it is difficult to distribute one bundle of sheets among plural image forming apparatuses 20 installed far away from each other. Accordingly, in this case, it is possible to select image forming apparatuses used for the adding calculation of the capacity of empty space.

Hereafter, it will be explained with reference to the flow chart of FIG. 25.

[Flow in the Case of Supplying Sheets to Plural Sheet Trays of the Selected Image Forming Apparatuses by One Bundle of Sheets as a Unit of Sheet Supply]

Figure 28:
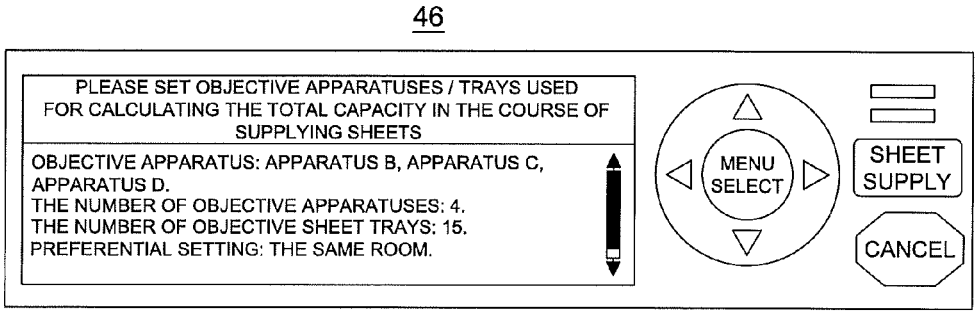
FIG. 28 is an illustration showing a structural example of a screen (administration condition setting screen) displayed on a display operating section of an image forming apparatus according to the second embodiment of the present invention.

First, at step S701, the control section 21 of the specific image forming apparatus 20 displays an administration condition setting screen 46 as shown in FIG. 28 at the display operating section 23. This administration condition setting screen 46 is provided with a column to set up, for example, image forming apparatuses 20 and sheet trays 28 of the image forming apparatuses 20 made as the administration object of the sheet supply supporting of this embodiment, image forming apparatus 20 to which priority is given in the case of sheet supply, and the like. A user sets up image forming apparatuses 20 and sheet trays 27 used for the adding calculation of the capacity of empty space by operating the display operating section 23. Then, the control section 21 memorizes the information in the ROM 21*b*, the HDD 22, etc.

Next, if needed, the control section 21 of the specific image forming apparatus 20 makes the display operating section 23 to display a notice time setting screen 42 as shown in FIG. 12. Then, a user sets up a notice time by operating the display operating section 23, and the control section 21 memorizes the notice time in the ROM 21*b*, the HDD 22, etc.

Next, at Step S703, the control section 21 of the specific image forming apparatus 20 discriminates the size and kind of sheets stored in each sheet tray 28. Further, from the other image forming apparatuses 20 selected at Step S701, the control section 21 of the specific image forming apparatus 20 obtains information to discriminate the size and kind of sheets stored in each sheet tray 28 of the other image forming apparatuses 20 through the communication I/F section 29. At this time, the control section 21 of the specific image forming apparatus 20 obtains information about the installed location of the other image forming apparatuses 20 and the like, if needed. Then, the information is stored in the ROM 21*b*, the HDD 22, etc.

Next, at Step S704, the control section 21 of one of the image forming apparatuses 20 forms an image based on a print job by controlling the image forming section 25, the printing department 26, and the sheet feeding section 27 of the image forming apparatus 20, conveys the sheet specified by the print job from the predetermined sheet tray 28, transfers the image onto the sheet, and outputs the sheet.

Next, at step S705, the capacity detecting section 28*a* (for example, a distance sensor) installed in each sheet tray 28 of the specific image forming apparatus 20 detects the capacity of empty space or the used capacity of each sheet tray 28. Further, from the other image forming apparatuses 20 selected at Step S701, the control section 21 of the specific image forming apparatuses 20 obtains the capacity of empty space or the used capacity of each sheet tray 28 of the other image forming apparatuses 20, and memorizes the capacity of empty space or the used capacity of each sheet tray 28 of the other image forming apparatuses 20 together with the capacity of empty space or the used capacity detected in itself in the ROM 21*b*, the HDD 22 and the like.

Next, at Step S706, the sheet managing section 24 (control program) of the specific image forming apparatus 20 specifies sheet trays 28 which store the sheets of the same size and the same kind on the basis of the information memorized at Step S703. Thereafter, the sheet managing section 24 adds up the capacity of empty space or the capacity of used sheets of the plural sheet trays 28 of the plural image forming apparatuses 20 storing the sheets of the same size and the same kind by using the capacity of empty space or the capacity of used sheets of each sheet tray 28 memorized at Step S705.

Next, at step S707, the sheet managing section 24 (control program) of the specific image forming apparatus compares the total capacity of the capacity of empty space or the capacity of used sheets calculated by the above step with the thickness of one bundle of sheets memorized at Step S702 for each sheet size and each sheet kind. Then, at Step S708, the sheet managing section 24 judges whether there is any combination of the sheet trays 28 in which the total capacity of the capacity of empty space or the capacity of used sheets becomes equal to or larger than the thickness of one bundle of sheets. As a result of the judgment, in the case that there is no combination of the sheet trays 28 which satisfies the above-mentioned condition, the procedure returns to Step S704 and the following print job is processed.

On the other hand, when there is a combination of the sheet trays 28 which satisfies the above-mentioned condition, at Step S709, the sheet managing section 24 (control program) of the specific image forming apparatus 20 makes the display operating section 23 to indicate the screens shown in FIGS. 26 and 27 so as to notify that it is possible to supply sheets by one bundle of sheets as a unit of supply.

At this time, in the case that there are plural combinations of the sheet trays 28, all the combinations of the sheet trays 28 can be indicated. Also, in the case that the image forming apparatus 20 provided with a priority is set up at Step S701, it is preferable to indicate a combination of the sheet trays 28 of the image forming apparatus 20 or it is preferable to indicate a combination of the sheet trays 28 of the image forming apparatus 20 installed at a position close to it. Further, as same as the above example, a judgment or a timing to notify and a method of notifying are optional. For example, a notice can be issued at the time that a user opens a sheet tray, at the time that a user expresses the intention to conduct sheet supply, and at the time that time becomes a notice time. Further, a notice can be issued by E-mail. Moreover, the propriety of sheet supply can be judged based on the number of sheets. Also, the procedure can be configured to judge whether sheets can be supplied by a plural bundle of sheets or a box of sheets as a unit of supply.

Here, the above flow shows the case where sheets of one bundle or plural bundles as a unit of sheet supply are distributed and supplied to plural sheet trays 28 of plural image forming apparatuses 20. However, when the capacity of empty space and the capacity of used sheets of any one of sheet trays of any one of image forming apparatuses 20 becomes equal to or more than a capacity of sheets of one bundle or plural bundles, it is also possible to notify that sheet supply by one bundle or plural bundles of sheets as a unit of sheet supply is possible. In this case, it is preferable to perform the same procedures as the flow chart of FIGS. 6 through 8 of the first embodiment.

Further, in the above flows, the specific image forming apparatus 20 judges whether or not sheet supply can be conducted. However, a computer terminal 30 connected to the communication network can also conduct the judgment.

As mentioned above, the sheet supply supporting method of this embodiment has been explained with the examples. However, the present invention is not limited to the description of the above-mentioned embodiment. The present invention includes arbitrary methods capable of judging whether sheets can be supplied by a desired amount of sheets, such as one bundle of sheets, plural bundle of sheets or a box of sheets as a unit of supply.

According to the image forming apparatus, sheet supply supporting method, and control program of the aforementioned exemplary embodiment of the present invention, sheets can be supplied by one or plural bundles of sheets as a unit of sheet supply.

The reason is that a sheet managing section (control program) of an image forming apparatus detects a capacity of empty space of each of one or plural sheet trays and compares the capacity of empty space of each of one or plural sheet trays with a capacity of sheets of one or plural bundles of sheets. As a result of the comparison, in the case that the capacity of empty space of each of one or plural sheet trays is not smaller that the capacity of sheets of one or plural bundles of sheets, the sheet managing section conducts a control to notify that it is possible to supply sheets by one or plural bundles of sheets as a unit of sheet supply.

What is claimed is:

1. A printing system, comprising:

a plurality of image forming apparatuses, each of the plurality of image forming apparatuses connected to a network and including a plurality of sheet trays to store sheets to form images thereon and a detecting section provided to each of the plurality of sheet trays and to detect a capacity of empty space of each of the plurality of sheet trays; and a sheet managing section to obtain a capacity of empty space of each of the plurality of sheet trays of each of the plurality of image forming apparatuses and to compare the capacity of empty space of each of the plurality of sheet trays with a capacity of sheets of one or plural bundles of sheets as a unit of supply to be stored in the plurality of sheet trays, wherein in the case that the capacity of empty space of a sheet tray among the plurality of sheet trays of each of the plurality of image forming apparatuses is equal to or larger than the capacity of sheets of one or plural bundles of sheets, the sheet managing section notifies that sheet supply can be conducted by one or plural bundle of sheets as a unit of supply to the sheet tray, and wherein the sheet managing section specifies plural sheet trays in plural image forming apparatuses storing sheets of the same size and the same kind among the plurality of sheet trays of each of the plurality of image forming apparatuses and compares a total capacity of empty space of the plural sheet trays with a capacity of sheets of one or plural bundles of sheets as a unit of supply to be stored in the plural sheet trays, and in the case that the total capacity of empty space is equal to or larger than the capacity of sheets of one or plural bundles of sheets, the sheet managing section notifies that sheet supply can be conducted by the one or plural bundle of sheets as a unit of supply to the plural sheet trays by distributing the one or plural bundle of sheets to the plural sheet trays in the plural image forming apparatuses.

2. The printing system described in claim 1, further comprising:

a display section;

wherein the sheet managing section controls the display section to indicate a screen to select image forming apparatuses and sheet trays in the printing system and makes the selected sheet trays in the image forming apparatuses as objects for an adding calculation of the total capacity of empty space.

3. The printing system described in claim 1, wherein in the case that there are plural combinations of sheet trays in which the total capacity of empty space of the sheet trays of each of the combinations becomes equal to or larger than the capacity of sheets of one or plural bundles of sheets, the sheet managing section notifies preferentially a combination in which image forming apparatuses having the sheet trays are located relatively close to each other.

4. A sheet supply supporting method in a printing system comprising a plurality of image forming apparatuses, wherein each of the plurality of image forming apparatuses is connected to a network and includes a plurality of sheet trays to store sheets to form images thereon and a detecting section provided to each of the plurality of sheet trays and to detect a capacity of empty space of each of the plurality of sheet trays, the sheet supply supporting method comprising:

a first step of registering a capacity of sheets of one or plural bundles of sheets as a unit of supply to be stored in the plurality of sheet trays of each of the plurality of image forming apparatuses;

a second step of detecting a capacity of empty space of each of the plurality of sheet trays of each of the plurality of image forming apparatuses by the detecting section and registering the detected capacity of empty space;

a third step of comparing the capacity of empty space of each of the plurality of sheet trays of each of the plurality of image forming apparatuses with the capacity of sheets of one or plural bundles of sheets; and a fourth step of, in the case that the capacity of empty space of a sheet tray among the plurality of sheet trays of each of the plurality of image forming apparatuses is equal to or larger than the capacity of sheets of the one or plural bundles of sheets, notifying that sheet supply can be conducted by the one or plural bundle of sheets as a unit of supply to the sheet tray, and wherein in the second step, plural sheet trays in plural image forming apparatuses storing sheets of the same size and the same kind are specified among the plurality of sheet trays of each of the plurality of image forming apparatuses, a capacity of empty space of each of the plural sheet trays is detected, and a total capacity of empty space of the plural sheet trays is calculated and registered;

in the third step, the total capacity of empty space is compared with the sheet capacity of one or plural bundles of sheets to be stored in the plural sheet trays; and in the fourth step, in the case that the total capacity of empty space is equal to or larger than the capacity of sheets of the one or plural bundles of sheets, it is notified that supply sheets can be conducted by the one or plural bundle of sheets as a unit of supply by distributing the one or plural bundle of sheets to the plural sheet trays in the plural image forming apparatuses.

5. The sheet supply supporting method described in claim 4, further comprising:

a step of indicating plural sheet trays in plural image forming apparatuses so as to make it possible to conduct selection;

wherein the first step through the fourth step are conducted for the selected sheet trays of the selected image forming apparatuses.

6. The sheet supply supporting method described in claim 4, in the fourth step, in the case that there are plural combinations of sheet trays in which a total capacity of empty space of the sheet trays of each of the combinations becomes equal to or larger than the capacity of sheets of one or plural bundles of sheets, a combination in which image forming apparatuses having the sheet trays are located relatively close to each other, is notified preferentially.

7. A non-transitory computer-readable recording medium storing a control program readable by a computer, wherein the control program is adapted to work in a printing system comprising a plurality of image forming apparatuses, each of the plurality of image forming apparatuses is connected to a network and includes a plurality of sheet trays to store sheets to form images thereon and a detecting section provided to each of the plurality of sheet trays and to detect a capacity of empty space of each of the plurality of sheet trays, the control program making the computer execute steps of:

obtaining a capacity of empty space of each of the plurality of sheet trays of each of the plurality of image forming apparatuses and comparing the capacity of empty space of each of the plurality of sheet trays with a capacity of sheets of one or plural bundles of sheets as a unit of supply to be stored in the plurality of sheet trays, in the case that the capacity of empty space of a sheet tray among the plurality of sheet trays of each of the plurality of image forming apparatuses is equal to or larger than the capacity of sheets of one or plural bundles of sheets, notifying that sheet supply can be conducted by one or plural bundle of sheets as a unit of supply to the sheet tray, and specifying plural sheet trays in plural image forming apparatuses storing sheets of the same size and the same kind and comparing a total capacity of empty space of the plural sheet trays with a capacity of sheets of one or plural bundles of sheets as a unit of supply to be stored in the plural sheet trays, and in the case that the total capacity of empty space is equal to or larger than the capacity of sheets of one or plural bundles of sheets, notifying that sheet supply can be conducted by the one or plural bundle of sheets as a unit of supply to the plural sheet trays by distributing the one or plural bundle of sheets to the plural sheet trays in the plural image forming apparatuses.

8. The non-transitory computer-readable recording medium described in claim 7, wherein the printing system further comprises:

a display section;

wherein the control program makes the computer further execute a step of controlling the display section to indicate a screen to select image forming apparatuses and sheet trays in the printing system and makes the selected sheet trays of the image forming apparatuses as objects for an adding calculation of the total capacity.

9. The non-transitory computer-readable recording medium described in claim 7, wherein in the case that there are plural combinations of sheet trays in which a total capacity of empty space of the sheet trays of each of the combinations becomes equal to or larger than the capacity of sheets of one or plural bundles of sheets, the control program makes the computer execute a step of notifying preferentially a combination in which image forming apparatuses having the sheet trays are located relatively close to each other.

* * * * *